US010229647B2

(12) United States Patent
Nathan et al.

(10) Patent No.: US 10,229,647 B2
(45) Date of Patent: Mar. 12, 2019

(54) METHOD AND SYSTEM FOR DRIVING AN ACTIVE MATRIX DISPLAY CIRCUIT

(71) Applicant: Ignis Innovation Inc., Waterloo (CA)

(72) Inventors: Arokia Nathan, Cambridge (GB); Gholamreza Chaji, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 0 days.

(21) Appl. No.: 14/491,885

(22) Filed: Sep. 19, 2014

(65) Prior Publication Data

US 2015/0009191 A1 Jan. 8, 2015

Related U.S. Application Data

(63) Continuation of application No. 13/649,888, filed on Oct. 11, 2012, now Pat. No. 9,269,322, which is a (Continued)

(30) Foreign Application Priority Data

Jan. 9, 2006 (CA) ..... 2535233
Jun. 27, 2006 (CA) ..... 2551237

(51) Int. Cl.
*G09G 3/36* (2006.01)
*G09G 3/3233* (2016.01)
*G09G 3/3266* (2016.01)

(52) U.S. Cl.
CPC ..... *G09G 3/3696* (2013.01); *G09G 3/3233* (2013.01); *G09G 3/3685* (2013.01); (Continued)

(58) Field of Classification Search
CPC ..... G09G 2320/043; G09G 2320/045; G09G 2300/0819; G09G 3/3639; G09G 3/3685; (Continued)

(56) References Cited

U.S. PATENT DOCUMENTS 3,506,851 A 4/1970 Polkinghorn et al.
3,750,987 A 8/1973 Gobel
(Continued)

FOREIGN PATENT DOCUMENTS

AU 729652 6/1997
AU 764896 12/2001
(Continued)

OTHER PUBLICATIONS

Ahnood et al.: "Effect of threshold voltage instability on field effect mobility in thin film transistors deduced from constant current measurements"; dated Aug. 2009.
(Continued)

*Primary Examiner* — William Boddie
*Assistant Examiner* — Saifeldin E Elnafia
(74) *Attorney, Agent, or Firm* — Stratford Managers Corporation

(57) ABSTRACT

A method and system for driving an active matrix display is provided. The system includes a drive circuit for a pixel having a light emitting device. The drive circuit includes a drive transistor for driving the light emitting device. The system includes a mechanism for adjusting the gate voltage of the drive transistor.

10 Claims, 41 Drawing Sheets

Related U.S. Application Data continuation-in-part of application No. 13/413,517, filed on Mar. 6, 2012, now Pat. No. 8,624,808, and a continuation-in-part of application No. 13/243,330, filed on Sep. 23, 2011, now Pat. No. 8,564,513, said application No. 13/413,517 is a continuation of application No. 11/651,099, filed on Jan. 9, 2007, now Pat. No. 8,253,665, said application No. 13/243,330 is a continuation of application No. 11/651,099, filed on Jan. 9, 2007, now Pat. No. 8,253,665.

(52) U.S. Cl.
CPC ..... *G09G 3/3266* (2013.01); *G09G 2300/043* (2013.01); *G09G 2300/0417* (2013.01); *G09G 2300/0426* (2013.01); *G09G 2300/0809* (2013.01); *G09G 2300/0819* (2013.01); *G09G 2300/0842* (2013.01); *G09G 2300/0861* (2013.01); *G09G 2310/0243* (2013.01); *G09G 2310/0251* (2013.01); *G09G 2310/0262* (2013.01); *G09G 2310/0272* (2013.01); *G09G 2320/029* (2013.01); *G09G 2320/043* (2013.01)

(58) Field of Classification Search
CPC ..... G09G 3/3233; G09G 2310/0272; G09G 2310/0251; G09G 2310/0243; G09G 2320/029; G09G 2300/043; G09G 3/3696; G09G 2310/0248; G09G 3/3258; G09G 3/3266; G09G 3/3275; G09G 2310/0262; G09G 2300/0417; G09G 2300/0861; G09G 2300/0809; G09G 2300/0842; G09G 2320/041; G09G 2320/048; G09G 2300/0426; G09G 2320/0295
See application file for complete search history.

(56) References Cited

U.S. PATENT DOCUMENTS 3,774,055 A 11/1973 Bapat et al.
4,090,096 A 5/1978 Nagami
4,354,162 A 10/1982 Wright
4,996,523 A 2/1991 Bell et al.
5,134,387 A 7/1992 Smith et al.
5,153,420 A 10/1992 Hack et al.
5,170,158 A 12/1992 Shinya
5,204,661 A 4/1993 Hack et al.
5,266,515 A 11/1993 Robb et al.
5,278,542 A 1/1994 Smith et al.
5,408,267 A 4/1995 Main
5,498,880 A 3/1996 Lee et al.
5,572,444 A 11/1996 Lentz et al.
5,589,847 A 12/1996 Lewis
5,619,033 A 4/1997 Weisfield
5,648,276 A 7/1997 Hara et al.
5,670,973 A 9/1997 Bassetti et al.
5,691,783 A 11/1997 Numao et al.
5,701,505 A 12/1997 Yamashita et al.
5,714,968 A 2/1998 Ikeda
5,744,824 A 4/1998 Kousai et al.
5,745,660 A 4/1998 Kolpatzik et al.
5,748,160 A 5/1998 Shieh et al.
5,758,129 A 5/1998 Gray et al.
5,835,376 A 11/1998 Smith et al.
5,870,071 A 2/1999 Kawahata
5,874,803 A 2/1999 Garbuzov et al.
5,880,582 A 3/1999 Sawada
5,903,248 A 5/1999 Irwin
5,917,280 A 6/1999 Burrows et al.
5,949,398 A 9/1999 Kim
5,952,789 A 9/1999 Stewart et al.
5,990,629 A 11/1999 Yamada et al.
6,023,259 A 2/2000 Howard et al.
6,069,365 A 5/2000 Chow et al.
6,091,203 A 7/2000 Kawashima et al.
6,097,360 A 8/2000 Holloman
6,100,868 A 8/2000 Lee et al.
6,144,222 A 11/2000 Ho
6,229,506 B1 5/2001 Dawson et al.
6,229,508 B1 5/2001 Kane
6,246,180 B1 6/2001 Nishigaki
6,252,248 B1 6/2001 Sano et al.
6,268,841 B1 7/2001 Cairns et al.
6,288,696 B1 9/2001 Holloman
6,307,322 B1 10/2001 Dawson et al.
6,310,962 B1 10/2001 Chung et al.
6,323,631 B1 11/2001 Juang
6,333,729 B1 12/2001 Ha
6,388,653 B1 5/2002 Goto et al.
6,392,617 B1 5/2002 Gleason
6,396,469 B1 5/2002 Miwa et al.
6,414,661 B1 7/2002 Shen et al.
6,417,825 B1 7/2002 Stewart et al.
6,430,496 B1 8/2002 Smith et al.
6,433,488 B1 8/2002 Bu
6,473,065 B1 10/2002 Fan
6,475,845 B2 11/2002 Kimura
6,501,098 B2 12/2002 Yamazaki
6,501,466 B1 12/2002 Yamagashi et al.
6,522,315 B2 2/2003 Ozawa et al.
6,535,185 B2 3/2003 Kim et al.
6,542,138 B1 * 4/2003 Shannon et al. ..... 345/76
6,559,839 B1 5/2003 Ueno et al.
6,580,408 B1 6/2003 Bae et al.
6,583,398 B2 6/2003 Harkin
6,618,030 B2 9/2003 Kane et al.
6,639,244 B1 10/2003 Yamazaki et al.
6,680,580 B1 1/2004 Sung
6,686,699 B2 2/2004 Yumoto
6,690,000 B1 2/2004 Muramatsu et al.
6,693,610 B2 2/2004 Shannon et al.
6,694,248 B2 2/2004 Smith et al.
6,697,057 B2 2/2004 Koyama et al.
6,724,151 B2 4/2004 Yoo
6,734,636 B2 5/2004 Sanford et al.
6,753,655 B2 6/2004 Shih et al.
6,753,834 B2 6/2004 Mikami et al.
6,756,741 B2 6/2004 Li
6,777,888 B2 8/2004 Kondo
6,781,567 B2 8/2004 Kimura
6,788,231 B1 9/2004 Hsueh
6,809,706 B2 10/2004 Shimoda
6,828,950 B2 12/2004 Koyama
6,858,991 B2 2/2005 Miyazawa
6,859,193 B1 2/2005 Yumoto
6,876,346 B2 4/2005 Anzai et al.
6,900,485 B2 5/2005 Lee
6,903,734 B2 6/2005 Eu
6,911,960 B1 6/2005 Yokoyama
6,911,964 B2 6/2005 Lee et al.
6,914,448 B2 7/2005 Jinno
6,919,871 B2 7/2005 Kwon
6,924,602 B2 8/2005 Komiya
6,937,220 B2 8/2005 Kitaura et al.
6,940,214 B1 9/2005 Komiya et al.
6,954,194 B2 10/2005 Matsumoto et al.
6,970,149 B2 11/2005 Chung et al.
6,975,142 B2 12/2005 Azami et al.
6,975,332 B2 12/2005 Arnold et al.
6,995,519 B2 2/2006 Arnold et al.
7,027,015 B2 4/2006 Booth, Jr. et al.
7,034,793 B2 4/2006 Sekiya et al.
7,038,392 B2 5/2006 Libsch et al.
7,057,588 B2 6/2006 Asano et al.
7,061,451 B2 6/2006 Kimura
7,071,932 B2 7/2006 Libsch et al.
7,106,285 B2 9/2006 Naugler
7,112,820 B2 9/2006 Chang et al.
7,113,864 B2 9/2006 Smith et al.
7,122,835 B1 10/2006 Ikeda et al.

(56) References Cited

U.S. PATENT DOCUMENTS 7,129,914 B2 10/2006 Knapp et al.
7,164,417 B2 1/2007 Cok
7,224,332 B2 5/2007 Cok
7,248,236 B2 7/2007 Nathan et al.
7,259,737 B2 8/2007 Ono et al.
7,262,753 B2 8/2007 Tanghe et al.
7,274,363 B2 9/2007 Ishizuka et al.
7,310,092 B2 12/2007 Forrest et al.
7,315,295 B2 1/2008 Kimura
7,317,434 B2 1/2008 Lan et al.
7,321,348 B2 1/2008 Cok et al.
7,327,357 B2 2/2008 Jeong
7,333,077 B2 2/2008 Koyama et al.
7,343,243 B2 3/2008 Smith et al.
7,414,600 B2 8/2008 Nathan et al.
7,432,991 B1 * 10/2008 Chang ..... G06F 3/0412 345/55
7,466,166 B2 12/2008 Date et al.
7,495,501 B2 2/2009 Iwabuchi et al.
7,502,000 B2 3/2009 Yuki et al.
7,515,124 B2 4/2009 Yaguma et al.
7,535,449 B2 5/2009 Miyazawa
7,554,512 B2 6/2009 Steer
7,569,849 B2 8/2009 Nathan et al.
7,595,776 B2 9/2009 Hashimoto et al.
7,604,718 B2 10/2009 Zhang et al.
7,609,239 B2 10/2009 Chang
7,612,745 B2 11/2009 Yumoto et al.
7,619,594 B2 11/2009 Hu
7,619,597 B2 11/2009 Nathan et al.
7,639,211 B2 12/2009 Miyazawa
7,683,899 B2 3/2010 Hirakata et al.
7,688,289 B2 3/2010 Abe et al.
7,760,162 B2 7/2010 Miyazawa
7,808,008 B2 10/2010 Miyake
7,859,520 B2 12/2010 Kimura
7,889,159 B2 2/2011 Nathan et al.
7,903,127 B2 3/2011 Kwon
7,920,116 B2 4/2011 Woo et al.
7,944,414 B2 5/2011 Shirasaki et al.
7,978,170 B2 7/2011 Park et al.
7,989,392 B2 8/2011 Crockett et al.
7,995,008 B2 8/2011 Miwa
8,063,852 B2 11/2011 Kwak et al.
8,102,343 B2 1/2012 Yatabe
8,144,081 B2 3/2012 Miyazawa
8,159,007 B2 4/2012 Bama et al.
8,242,979 B2 8/2012 Anzai et al.
8,253,665 B2 8/2012 Nathan et al.
8,319,712 B2 11/2012 Nathan et al.
2001/0002703 A1 6/2001 Koyama
2001/0009283 A1 7/2001 Arao et al.
2001/0026257 A1 10/2001 Kimura
2001/0030323 A1 10/2001 Ikeda
2001/0040541 A1 11/2001 Yoneda et al.
2001/0043173 A1 11/2001 Troutman
2001/0045929 A1 11/2001 Prache
2001/0052940 A1 12/2001 Hagihara et al.
2002/0000576 A1 1/2002 Inukai
2002/0011796 A1 1/2002 Koyama
2002/0011799 A1 1/2002 Kimura
2002/0012057 A1 1/2002 Kimura
2002/0030190 A1 3/2002 Ohtani et al.
2002/0047565 A1 4/2002 Nara et al.
2002/0052086 A1 5/2002 Maeda
2002/0080108 A1 6/2002 Wang
2002/0084463 A1 7/2002 Sanford et al.
2002/0101172 A1 8/2002 Bu
2002/0117722 A1 8/2002 Osada et al.
2002/0140712 A1 10/2002 Ouchi et al.
2002/0158587 A1 10/2002 Komiya
2002/0158666 A1 10/2002 Azami et al.
2002/0158823 A1 10/2002 Zavracky et al.
2002/0171613 A1 11/2002 Goto et al.
2002/0186214 A1 12/2002 Siwinski
2002/0190971 A1 12/2002 Nakamura et al.
2002/0195967 A1 12/2002 Kim et al.
2002/0195968 A1 12/2002 Sanford et al.
2003/0001828 A1 1/2003 Asano
2003/0020413 A1 1/2003 Oomura
2003/0030603 A1 2/2003 Shimoda
2003/0062524 A1 4/2003 Kimura
2003/0062844 A1 4/2003 Miyazawa
2003/0076048 A1 4/2003 Rutherford
2003/0090445 A1 5/2003 Chen et al.
2003/0090447 A1 5/2003 Kimura
2003/0090481 A1 5/2003 Kimura
2003/0095087 A1 5/2003 Libsch
2003/0098829 A1 5/2003 Chen et al.
2003/0107560 A1 6/2003 Yumoto et al.
2003/0107561 A1 6/2003 Uchino et al.
2003/0111966 A1 6/2003 Mikami et al.
2003/0112205 A1 6/2003 Yamada
2003/0112208 A1 6/2003 Okabe et al.
2003/0117348 A1 6/2003 Knapp et al.
2003/0122474 A1 7/2003 Lee
2003/0122747 A1 7/2003 Shannon et al.
2003/0128199 A1 7/2003 Kimura
2003/0151569 A1 8/2003 Lee et al.
2003/0156104 A1 8/2003 Morita
2003/0169241 A1 9/2003 LeChevalier
2003/0169247 A1 9/2003 Kawabe et al.
2003/0174152 A1 9/2003 Noguchi
2003/0179626 A1 9/2003 Sanford et al.
2003/0185438 A1 10/2003 Osawa et al.
2003/0189535 A1 10/2003 Matsumoto et al.
2003/0197663 A1 10/2003 Lee et al.
2003/0214465 A1 11/2003 Kimura
2003/0227262 A1 12/2003 Kwon
2003/0230141 A1 12/2003 Gilmour et al.
2003/0230980 A1 12/2003 Forrest et al.
2004/0004589 A1 1/2004 Shih
2004/0032382 A1 2/2004 Cok et al.
2004/0041750 A1 3/2004 Abe
2004/0066357 A1 4/2004 Kawasaki
2004/0070557 A1 4/2004 Asano et al.
2004/0070558 A1 * 4/2004 Cok ..... G09G 3/3225 345/76
2004/0129933 A1 7/2004 Nathan et al.
2004/0135749 A1 7/2004 Kondakov et al.
2004/0145547 A1 7/2004 Oh
2004/0150595 A1 8/2004 Kasai
2004/0155841 A1 8/2004 Kasai
2004/0160516 A1 8/2004 Ford
2004/0171619 A1 9/2004 Libsch et al.
2004/0174349 A1 9/2004 Libsch
2004/0174354 A1 9/2004 Ono
2004/0183759 A1 9/2004 Stevenson et al.
2004/0189627 A1 9/2004 Shirasaki et al.
2004/0196275 A1 10/2004 Hattori
2004/0227697 A1 11/2004 Mori
2004/0239696 A1 12/2004 Okabe
2004/0251844 A1 12/2004 Hashido et al.
2004/0252085 A1 12/2004 Miyagawa
2004/0252089 A1 12/2004 Ono et al.
2004/0256617 A1 12/2004 Yamada et al.
2004/0257353 A1 12/2004 Imamura et al.
2004/0257355 A1 12/2004 Naugler
2004/0263437 A1 12/2004 Hattori
2005/0007357 A1 1/2005 Yamashita et al.
2005/0030267 A1 * 2/2005 Tanghe ..... G09G 3/3216 345/82
2005/0052379 A1 3/2005 Waterman
2005/0057459 A1 3/2005 Miyazawa
2005/0067970 A1 3/2005 Libsch et al.
2005/0067971 A1 3/2005 Kane
2005/0083270 A1 4/2005 Miyazawa
2005/0110420 A1 5/2005 Arnold et al.
2005/0110727 A1 5/2005 Shin
2005/0123193 A1 6/2005 Lamberg et al.
2005/0140610 A1 6/2005 Smith et al.
2005/0145891 A1 7/2005 Abe
2005/0156831 A1 7/2005 Yamazaki et al.
2005/0168416 A1 8/2005 Hashimoto et al.

(56) References Cited

U.S. PATENT DOCUMENTS

2005/0206590 A1 9/2005 Sasaki et al.
2005/0219188 A1 10/2005 Kawabe et al.
2005/0243037 A1 11/2005 Eom et al.
2005/0248515 A1 11/2005 Naugler et al.
2005/0258867 A1 11/2005 Miyazawa
2005/0285825 A1 12/2005 Eom et al.
2006/0012311 A1 1/2006 Ogawa
2006/0038750 A1 2/2006 Inoue et al.
2006/0038758 A1 2/2006 Routley et al.
2006/0038762 A1 2/2006 Chou
2006/0066533 A1 3/2006 Sato et al.
2006/0077077 A1 4/2006 Kwon
2006/0082523 A1* 4/2006 Guo et al. ..... 345/76
2006/0125408 A1 6/2006 Nathan et al.
2006/0139253 A1 6/2006 Choi et al.
2006/0145964 A1 7/2006 Park et al.
2006/0191178 A1 8/2006 Sempel et al.
2006/0209012 A1 9/2006 Hagood, IV
2006/0214888 A1 9/2006 Schneider et al.
2006/0221009 A1 10/2006 Miwa
2006/0227082 A1 10/2006 Ogata et al.
2006/0232522 A1 10/2006 Roy et al.
2006/0244391 A1 11/2006 Shishido et al.
2006/0244697 A1 11/2006 Lee et al.
2006/0261841 A1 11/2006 Fish
2006/0290614 A1 12/2006 Nathan et al.
2007/0001939 A1 1/2007 Hashimoto et al.
2007/0001945 A1 1/2007 Yoshida et al.
2007/0008251 A1 1/2007 Kohno et al.
2007/0008297 A1 1/2007 Bassetti
2007/0035707 A1 2/2007 Margulis
2007/0040773 A1 2/2007 Lee et al.
2007/0040782 A1 2/2007 Woo et al.
2007/0057874 A1 3/2007 Le Roy et al.
2007/0063932 A1 3/2007 Nathan et al.
2007/0075957 A1* 4/2007 Chen ..... G09G 3/3685 345/98
2007/0080908 A1 4/2007 Nathan et al.
2007/0085801 A1 4/2007 Park et al.
2007/0109232 A1 5/2007 Yamamoto et al.
2007/0128583 A1 6/2007 Miyazawa
2007/0164941 A1 7/2007 Park et al.
2007/0182671 A1 8/2007 Nathan et al.
2007/0236430 A1 10/2007 Fish
2007/0236440 A1 10/2007 Wacyk et al.
2007/0241999 A1 10/2007 Lin
2007/0242008 A1 10/2007 Cummings
2008/0001544 A1 1/2008 Murakami et al.
2008/0043044 A1 2/2008 Woo et al.
2008/0048951 A1 2/2008 Naugler et al.
2008/0055134 A1 3/2008 Li et al.
2008/0088549 A1 4/2008 Nathan et al.
2008/0094426 A1 4/2008 Kimpe
2008/0111766 A1 5/2008 Uchino et al.
2008/0122819 A1 5/2008 Cho et al.
2008/0129906 A1 6/2008 Lin et al.
2008/0198103 A1 8/2008 Toyomura et al.
2008/0228562 A1 9/2008 Smith et al.
2008/0231625 A1 9/2008 Minami et al.
2008/0231641 A1 9/2008 Miyashita
2008/0265786 A1 10/2008 Koyama
2008/0290805 A1 11/2008 Yamada et al.
2009/0009459 A1 1/2009 Miyashita
2009/0015532 A1 1/2009 Katayama et al.
2009/0058789 A1 3/2009 Hung et al.
2009/0121988 A1 5/2009 Amo et al.
2009/0146926 A1 6/2009 Sung et al.
2009/0153448 A1 6/2009 Tomida et al.
2009/0153459 A9 6/2009 Han et al.
2009/0174628 A1 7/2009 Wang et al.
2009/0201230 A1 8/2009 Smith
2009/0201281 A1 8/2009 Routley et al.
2009/0206764 A1 8/2009 Schemmann et al.
2009/0244046 A1 10/2009 Seto
2009/0251486 A1 10/2009 Sakakibara et al.
2009/0278777 A1 11/2009 Wang et al.
2009/0289964 A1 11/2009 Miyachi
2010/0039451 A1 2/2010 Jung
2010/0039453 A1 2/2010 Nathan et al.
2010/0079419 A1 4/2010 Shibusawa
2010/0207920 A1 8/2010 Chaji et al.
2010/0225634 A1 9/2010 Levey et al.
2010/0251295 A1 9/2010 Amento et al.
2010/0269889 A1 10/2010 Reinhold et al.
2010/0277400 A1 11/2010 Jeong
2010/0315319 A1 12/2010 Cok et al.
2011/0050741 A1 3/2011 Jeong
2011/0063197 A1 3/2011 Chung et al.
2011/0069089 A1 3/2011 Kopf et al.
2011/0169805 A1 7/2011 Yamazaki
2012/0169793 A1 7/2012 Nathan
2012/0299976 A1 11/2012 Chen et al.

FOREIGN PATENT DOCUMENTS

CA 1 294 034 1/1992
CA 2 249 592 7/1998
CA 2 303 302 3/1999
CA 2 368 386 9/1999
CA 2 242 720 1/2000
CA 2 354 018 6/2000
CA 2 432 530 7/2002
CA 2 436 451 8/2002
CA 2 507 276 8/2002
CA 2 463 653 1/2004
CA 2 498 136 3/2004
CA 2 522 396 11/2004
CA 2 438 363 2/2005
CA 2 443 206 3/2005
CA 2 519 097 3/2005
CA 2 472 671 12/2005
CA 2 523 841 1/2006
CA 2 567 076 1/2006
CA 2 495 726 7/2006
CA 2 557 713 11/2006
CA 2 526 782 C 8/2007
CA 2 651 893 11/2007
CA 2 672 590 10/2009
CN 1601594 A 3/2005
CN 1700285 A 11/2005
CN 1886774 12/2006
CN 101395653 A 3/2009
CN 102129842 A 7/2011
DE 202006007613 9/2006
EP 0 478 186 4/1992
EP 1 028 471 A 8/2000
EP 1 130 565 A1 9/2001
EP 1 194 013 4/2002
EP 1 321 922 6/2003
EP 1 335 430 A1 8/2003
EP 1 381 019 1/2004
EP 1 429 312 A 6/2004
EP 1 439 520 A2 7/2004
EP 1 465 143 A 10/2004
EP 1 473 689 A 11/2004
EP 1 517 290 A2 3/2005
EP 1 521 203 A2 4/2005
GB 2 399 935 9/2004
GB 2 460 018 11/2009
JP 09 090405 4/1997
JP 10-254410 9/1998
JP 11 231805 8/1999
JP 2002-278513 9/2002
JP 2003-076331 3/2003
JP 2003-099000 4/2003
JP 2003-173165 6/2003
JP 2003-186439 7/2003
JP 2003-195809 7/2003
JP 2003-271095 9/2003
JP 2003-308046 10/2003
JP 2004-054188 2/2004
JP 2004-226960 8/2004
JP 2005-004147 1/2005
JP 2005-099715 4/2005

(56) References Cited

FOREIGN PATENT DOCUMENTS

| | | | |
|---|---|---|---|
| JP | 2005-258326 | | 9/2005 |
| JP | 2005-338819 | | 12/2005 |
| TW | 569173 | | 1/2004 |
| TW | 200526065 | | 8/2005 |
| TW | 1239501 | | 9/2005 |
| WO | WO 98/11554 | | 3/1998 |
| WO | WO 99/48079 | | 9/1999 |
| WO | WO 01/27910 | A1 | 4/2001 |
| WO | WO 02/067327 | A | 8/2002 |
| WO | WO 03/034389 | | 4/2003 |
| WO | WO 03/063124 | | 7/2003 |
| WO | WO 03/075256 | | 9/2003 |
| WO | WO 2004/003877 | | 1/2004 |
| WO | WO 2004/015668 | A1 | 2/2004 |
| WO | WO 2004/034364 | | 4/2004 |
| WO | WO 2005/022498 | | 3/2005 |
| WO | WO 2005/055185 | | 6/2005 |
| WO | WO 2005/055186 | A1 | 6/2005 |
| WO | WO 2005/069267 | | 7/2005 |
| WO | WO 2005/122121 | | 12/2005 |
| WO | WO 2006/063448 | | 6/2006 |
| WO | WO 2006/128069 | | 11/2006 |
| WO | WO 2008/057369 | | 5/2008 |
| WO | WO 2008/0290805 | | 11/2008 |
| WO | WO 2009/059028 | | 5/2009 |
| WO | WO 2009/127065 | | 10/2009 |
| WO | WO 2010/066030 | | 6/2010 |
| WO | WO 2010/120733 | | 10/2010 |

OTHER PUBLICATIONS

Alexander et al.: "Pixel circuits and drive schemes for glass and elastic AMOLED displays"; dated Jul. 2005 (9 pages).
Alexander et al.: "Unique Electrical Measurement Technology for Compensation Inspection and Process Diagnostics of AMOLED HDTV"; dated May 2010 (4 pages).
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T—and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated May 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High- Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated May 2008 (177 pages).
Chapter 3: Color Spaces "Keith Jack: "Video Demystified:" A Handbook for the Digital Engineer" 2001 Referex ORD-0000-00-00 USA EP040425529 ISBN: 1-878707-56-6 pp. 32-33.
Chapter 8: Alternative Flat Panel Display 1-25 Technologies; Willem den Boer: "Active Matrix Liquid Crystal Display: Fundamentals and Applications" 2005 Referex ORD-0000-00-00 U.K.; XP040426102 ISBN: 0-7506-7813-5 pp. 206-209 p. 208.
European Partial Search Report Application No. 12 15 6251.6 European Patent Office dated May 30, 2012 (7 pages).
European Patent Office Communication Application No. 05 82 1114 dated Jan. 11, 2013 (9 pages).
European Patent Office Communication with Supplemental European Search Report for EP Application No. 07 70 1644.2 dated Aug. 18, 2009 (12 pages).
European Search Report Application No. 10 83 4294.0-1903 dated Apr. 8, 2013 (9 pages).
European Search Report Application No. EP 05 80 7905 dated Apr. 2, 2009 (5 pages).
European Search Report Application No. EP 05 82 1114 dated Mar. 27, 2009 (2 pages).
European Search Report Application No. EP 07 70 1644 dated Aug. 5, 2009.
European Search Report Application No. EP 10 17 5764 dated Oct. 18, 2010 (2 pages).
European Search Report Application No. EP 10 82 9593.2 European Patent Office dated May 17, 2013 (7 pages).
European Search Report Application No. EP 12 15 6251.6 European Patent Office dated Oct. 12, 2012 (18 pages).
European Search Report Application No. EP. 11 175 225.9 dated Nov. 4, 2011 (9 pages).
European Supplementary Search Report Application No. EP 09 80 2309 dated May 8, 2011 (14 pages).
European Supplementary Search Report Application No. EP 09 83 1339.8 dated Mar. 26, 2012 (11 pages).
Extended European Search Report Application No. EP 06 75 2777.0 dated Dec. 6, 2010 (21 pages).
Extended European Search Report Application No. EP 09 73 2338.0 dated May 24, 2011 (8 pages).

(56) References Cited

OTHER PUBLICATIONS

Extended European Search Report Application No. EP 11 17 5223., 4 dated Nov. 8, 2011 (8 pages).
Extended European Search Report Application No. EP 12 17 4465.0 European Patent Office dated Sep. 7, 2012 (9 pages).
Fan et al. "LTPS_TFT Pixel Circuit Compensation for TFT Threshold Voltage Shift and IR-Drop on the Power Line for Amolded Displays" 5 pages copyright 2012.
Goh et al. "A New a-Si:H Thin-Film Transistor Pixel Circuit for Active-Matrix Organic Light-Emitting Diodes" IEEE Electron Device Letters vol. 24 No. 9 Sep. 2003 pp. 583-585.
International Search Report Application No. PCT/CA2005/001844 dated Mar. 28, 2006 (2 pages).
International Search Report Application No. PCT/CA2006/000941 dated Oct. 3, 2006 (2 pages).
International Search Report Application No. PCT/CA2007/000013 dated May 7, 2007.
International Search Report Application No. PCT/CA2009/001049 dated Dec. 7, 2009 (4 pages).
International Search Report Application No. PCT/CA2009/001769 dated Apr. 8, 2010.
International Search Report Application No. PCT/IB2010/002898 Canadian Intellectual Property Office dated Jul. 28, 2009 (5 pages).
International Search Report Application No. PCT/IB2010/055481 dated Apr. 7, 2011 (3 pages).
International Search Report Application No. PCT/IB2011/051103 dated Jul. 8, 2011 3 pages.
International Search Report Application No. PCT/IB2012/052651 5 pages dated Sep. 11, 2012.
International Searching Authority Written Opinion Application No. PCT/IB2010/055481 dated Apr. 7, 2011 (6 pages ).
International Searching Authority Written Opinion Application No. PCT/IB2012/052651 6 pages dated Sep. 11, 2012.
International Searching Authority Written Opinion Application No. PCT/IB2011/051103 dated Jul. 8, 2011 6 pages.
International Searching Authority Written Opinion Application No. PCT/IB2010/002898 Canadian Intellectual Property Office dated Mar. 30, 2011 (8 pages).
International Searching Authority Written Opinion Application No. PCT/CA2009/001769 dated Apr. 8, 2010 (8 pages).
Jafarabadiashtiani et al.: "A New Driving Method for a-Si AMOLED Displays Based on Voltage Feedback"; dated May 2005 (4 pages).
Lee et al.: "Ambipolar Thin-Film Transistors Fabricated by PECVD Nanocrystalline Silicon"; dated May 2006 (6 pages).
Ma e y et al: "Organic Light-Emitting Diode/Thin Film Transistor Integration for foldable Displays" Conference record of the 1997 International display research conference and international workshops on LCD technology and emissive technology. Toronto Sep. 15-19, 1997 (6 pages).
Matsueda y et al.: "35.1: 2.5-in. AMOLED with Integrated 6-bit Gamma Compensated Digital Data Driver"; dated May 2004 (4 pages).
Nathan et al. "Amorphous Silicon Thin Film Transistor Circuit Integration for Organic LED Displays on Glass and Plastic" IEEE Journal of Solid-State Circuits vol. 39 No. 9 Sep. 2004 pp. 1477-1486.
Nathan et al.: "Backplane Requirements for Active Matrix Organic Light Emitting Diode Displays"; dated Sep. 2006 (16 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a -Si for AMOLED—Meeting the Performance and Cost Demands of Display Applications (Cell Phone to HDTV)"; dated Jun. 2006 (4 pages).
Nathan et al.: "Thin film imaging technology on glass and plastic"; dated Oct. 31-Nov. 2, 2000 (4 pages).
Ono et al. "Shared Pixel Compensation Circuit for AM-OLED Displays " Proceedings of the 9$^{th}$ Asian Symposium on Information Display (ASID) pp. 462-465 New Delhi dated Oct. 8-12, 2006 (4 pages).
Philipp: "Charge transfer sensing" Sensor Review vol. 19 No. 2 Dec. 31, 1999 (Dec. 31, 1999) 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Smith, Lindsay I., "A tutorial on Principal Components Analysis," dated Feb. 26, 2001 (27 pages).
Stewart M. et al. "Polysilicon TFT technology for active matrix OLED displays" IEEE transactions on electron devices vol. 48 No. 5 May 2001 (7 pages).
Vygranenko et al.: "Stability of indium-oxide thin-film transistors by reactive ion beam assisted deposition"; dated Feb. 2009.
Wang et al.: "Indium oxides by reactive ion beam assisted evaporation: From material study to device application," dated Mar. 2009 (6 pages).
Yi He et al. "Current-Source a-Si:H Thin Film Transistor Circuit for Active-Matrix Organic Light-Emitting Displays" IEEE Electron Device Letters vol. 21 No. 12 Dec. 2000 pp. 590-592.
International Search Report Application No. PCT/IB2013/059074, dated Dec. 18, 2013 (5 pages).
Extended European Search Report for Application No. EP 13845041.6, dated May 30, 2016 (9 pages).
International Search Report for Application No. PCT/IB2017/050170, dated May 5, 2017 (3 pages).
Written Opinion for Application No. PCT/IB2017/050170, dated May 5, 2017 (4 pages).

* cited by examiner

METHOD AND SYSTEM FOR DRIVING AN ACTIVE MATRIX DISPLAY CIRCUIT

CROSS-REFERENCE TO RELATED APPLICATION(S)

This application is a continuation of application Ser. No. 13/649,888, filed Oct. 11, 2012, which is a continuation-in-part of application Ser. No. 13/413,517, filed Mar. 6, 2012, now U.S. Pat. No. 8,624,808, and application Ser. No. 13/243,330, filed Sep. 23, 2011, now U.S. Pat. No. 8,564,513, application Ser. Nos. 13/413,517 and 13/243,330 are both continuations of application Ser. No. 11/651,099, filed Jan. 9, 2007, now U.S. Pat. No. 8,253,665, each of the above noted applications is hereby incorporated by reference herein in its entirety. This application further claims priority to Canadian Patent Application No. 2,535,233, filed on Jan. 9, 2006, and Canadian Application No. 2,551,237, filed on Jun. 27, 2006, each of which is hereby incorporated by reference herein in its entirety.

FIELD OF INVENTION

The invention relates to a light emitting device, and more specifically to a method and system for driving a pixel circuit having a light emitting device.

BACKGROUND OF THE INVENTION

Electro-luminance displays have been developed for a wide variety of devices, such as cell phones. In particular, active-matrix organic light emitting diode (AMOLED) displays with amorphous silicon (a-Si), poly-silicon, organic, or other driving backplane have become more attractive clue to advantages, such as feasible flexible displays, its low cost fabrication, high resolution, and a wide viewing angle.

An AMOLED display includes an array of rows and columns of pixels, each having an organic light emitting diode (OLED) and backplane electronics arranged in the array of rows and columns. Since the OLED is a current driven device, the pixel circuit of the AMOLED should be capable of providing an accurate and constant drive current There is a need to provide a method and system that is capable of providing constant brightness with high accuracy and reducing the effect of the aging of the pixel circuit and the instability of backplane and a light emitting device.

SUMMARY OF THE INVENTION

It is an object of the invention to provide a method and system that obviates or mitigates at least one of the disadvantages of existing systems.

In accordance with an aspect of the present invention there is provided a system a display system, including a drive circuit for a pixel having a light emitting device. The drive circuit includes a drive transistor connected to the light emitting device. The drive transistor includes a gate terminal, a first terminal and a second terminal. The drive circuit includes a first transistor including a gate terminal, a first terminal and a second terminal, the gate terminal of the first transistor being connected to a select line, the first terminal of the first transistor being connected to a data line, the second terminal of the first transistor being connected to the gate terminal of the drive transistor. The drive circuit includes a circuit for adjusting the gate voltage of the drive transistor, the circuit including a discharging transistor having a gate terminal, a first terminal and a second terminal, the gate terminal of the discharging transistor being connected to the gate terminal of the drive transistor at a node, the voltage of the node being discharged through the discharging transistor. The drive circuit includes a storage capacitor including a first terminal and a second terminal, the first terminal of the storage capacitor being connected to the gate terminal of the drive transistor at the node.

The display system may include a display array having a plurality of pixel circuits arranged in rows and columns, each of the pixel circuits including the drive circuit, and a driver for driving the display array. The gate terminal of the second transistor is connected to a bias line. The bias line may be shared by more than one pixel circuit of the plurality of pixel circuits.

In accordance with a further aspect of the present invention there is provided a method for the display system. The display system includes a driver for providing a programming cycle, a compensation cycle and a driving cycle for each row. The method includes the steps of at the programming cycle for a first row, selecting the address line for the first row and providing programming data to the first row, at the compensation cycle for the first row, selecting the adjacent address line for a second row adjacent to the first row and disenabling the address line for the first row, and at the driving cycle for the first row, disenabling the adjacent address line.

In accordance with a further aspect of the present invention there is provided a display system, including one or more than one pixel circuit, each including a light emitting device and a drive circuit. The drive circuit includes a drive transistor including a gate terminal, a first terminal and a second terminal, the drive transistor being between the light emitting device and a first power supply. The drive circuit includes a switch transistor including a gate terminal, a first terminal and a second terminal, the gate terminal of the switch transistor being connected to a first address line, the first terminal of the switch transistor being connected to a data line, the second terminal of the switch transistor being connected to the gate terminal of the drive transistor. The drive circuit includes a circuit for adjusting the gate voltage of the drive transistor, the circuit including a sensor for sensing energy transfer from the pixel circuit and a discharging transistor, the sensor having a first terminal and a second terminal, a property of the sensor varying in dependence upon the sensing result, the discharging transistor having a gate terminal, a first terminal and a second terminal, the gate terminal of the discharging transistor being connected to a second address line, the first terminal of the discharging: transistor being connected to the gate terminal of the drive transistor at a node, the second terminal of the discharging transistor being connected to the first terminal of the sensor, The drive circuit includes a storage capacitor including a first terminal and a second terminal, the first terminal of the storage capacitor being connected to the gate terminal of the drive transistor at the node.

In accordance with a further aspect of the present invention there is provided a method for a display system, including the step of implementing an in-pixel compensation.

In accordance with a further aspect of the present invention there is provided a method for a display system, including the step of implementing an of-panel compensation In accordance with a further aspect of the present invention there is provided a method for a display system, which includes a pixel circuit having a sensor, including the step of reading back the aging of the sensor.

In accordance with a further aspect of the present invention there is provided a display system, including a display array including a plurality of pixel circuits arranged in rows and columns, each including a light emitting device and a drive circuit; and a drive system for driving the display array. The drive circuit includes a drive transistor including a gate terminal, a first terminal and a second terminal, the drive transistor being between the light emitting device and a first power supply. The drive circuit includes a first transistor including a gate terminal, a first terminal and a second terminal, the gate terminal of the first transistor being connected to an address line, the first terminal of the fast transistor being connected to a data line, the second terminal of the first transistor being connected to the gate terminal of the drive transistor. The drive circuit includes a circuit for adjusting the voltage of the drive transistor, the circuit including a second transistor, the second transistor having a gate terminal, a first terminal and a second terminal, the gate terminal of the second transistor being connected to a control line, the first terminal of the second transistor being connected to the gate terminal of the drive transistor. The drive circuit includes a storage capacitor including a first terminal and a second terminal, the first terminal of the storage capacitor being connected to the gate terminal of the drive transistor, The drive system drives the pixel circuit so that the pixel circuit is turned off for a portion of a frame time.

In accordance with a further aspect of the present invention there is provided a method for a display system having a display array and a driver system. The drive system provides a frame time having a programming cycle, a discharge cycle, an emission cycle, a reset cycle, and a relaxation cycle, for each row. The method includes the steps of at the programming cycle, programming the pixel circuits on the row by activating the address line for the row; at the discharge cycle, partially discharging the voltage on the gate terminal of the drive transistor by deactivating the address line for the row and activating the control line for the row; at the emission cycle, deactivating the control line for the row, and controlling the light emitting device by the drive transistor; at the reset cycle, discharging the voltage on the gate terminal of the drive transistor by activating the control line for the row; and at the relaxation cycle, deactivating the control line for the row.

BRIEF DESCRIPTION OF THE DRAWINGS

These and other features of the invention will become more apparent from the following description in which reference is made to the appended drawings wherein.

DETAILED DESCRIPTION

Figure 1:
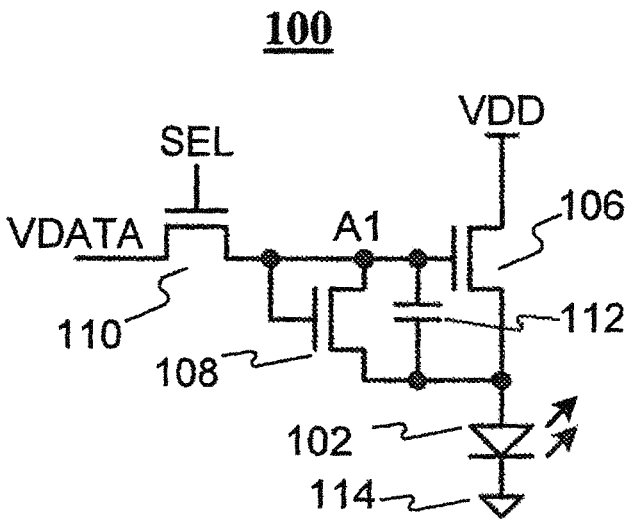
FIG. 1 is a diagram illustrating an example of a pixel circuit to which a pixel drive scheme in accordance with an embodiment of the present invention is applied.

FIG. 1 illustrates an example of a pixel circuit to which a pixel drive scheme in accordance with an embodiment of the present invention is applied. The pixel circuit 100 of FIG. 1 includes an OLED 102 and a drive circuit 104 for driving the OLED 102. The drive circuit 104 includes a drive transistor 106, a discharging transistor 108, a switch transistor 110, and a storage capacitor 112. The OLED 102 includes, for example, an anode electrode, a cathode electrode and an emission layer between the anode electrode and the cathode electrode.

In the description below, "pixel circuit" and "pixel" are used interchangeably. In the description below, "signal" and "line" may be used interchangeably. In the description below, the terms "line" and "node" may be used interchangeably. In the description, the terms "select line" and "address line" may be used interchangeably. In the description below, "connect (or connected)" and "couple (or coupled)" may be used interchangeably, and may be used to—indicate that two or more elements are directly or indirectly in physical or electrical contact with each other.

In one example, the transistors 106, 108 and 110 are n-type transistors. In another example, the transistors 106, 108 and 110 are p-type transistors or a combination of n-type and p-type transistors. In one example, each of the transistors 106;108 and 110 includes a gate terminal, a source terminal and a drain terminal, The transistors 106, 108 and 110 may be fabricated using amorphous silicon, nano/micro crystalline silicon, poly silicon, organic semiconductors technologies (e.g., organic TFT), NMOS/PMOS technology or CMOS technology (e.g., MOSFET).

The drive transistor 106 is provided between a voltage supply line VDD and the OLED 102. One terminal of the drive transistor 106 is connected to VDD. The other terminal of the drive transistor 106 is connected to one electrode (e.g., anode electrode) of the OLED 102. One terminal of the discharging transistor 108 and its gate terminal are connected to the gate terminal of drive transistor 106 at node A1. The other terminal of the discharging transistor 108 is connected to the OLED 102. The gate terminal of the switch transistor 110 is connected to a select line SEL. One terminal of the switch transistor 110 is connected to a data line VDATA. The other terminal of the switch transistor 110 is connected to node A1. One terminal of the storage capacitor 112 is connected to node A1. The other terminal of the storage capacitor 112 is connected to the OLED 102. The other electrode (e.g., cathode electrode) of the OLED 102 is connected to a power supply line (e.g., common ground) 114.

The pixel circuit 100 provides constant averaged current over the frame time by adjusting the gate voltage of the drive transistor 106, as described below.

Figure 2:
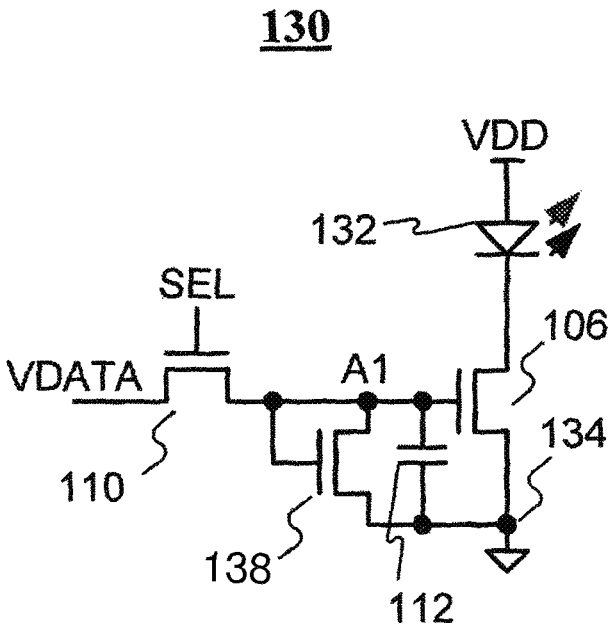
FIG. 2 is a diagram illustrating another example of a pixel circuit having a drive circuit of FIG. 1.

FIG. 2 illustrates another example of a pixel circuit having the drive circuit 104 of FIG. 1. The pixel circuit 130 is similar to the pixel circuit 100 of FIG. 1. The pixel circuit 130 includes an OLED 132. The OLED 132 may be same or similar to the OLED 102 of FIG. 1. In the pixel circuit 130, the drive transistor 106 is provided between one electrode (e.g., cathode electrode) of the OLED 132 and a power supply line (e.g., common ground) 134. One terminal of the discharging transistor 138 and one terminal of the storage capacitor 112 are connected to the power supply line 134. The other electrode (e.g., anode electrode) of the OLED 132 is connected to VDD.

The pixel circuit 130 provides constant averaged current over the frame time, in a manner similar to that of the pixel circuit 100 of FIG. 1.

Figure 3:
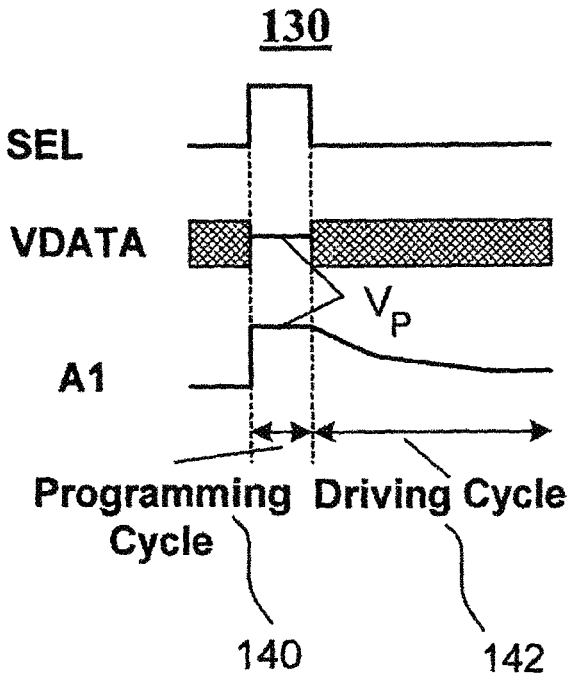
FIG. 3 is a timing diagram for an example of a method of driving a pixel circuit in accordance with an embodiment of the present invention.

FIG. 3 illustrates an example of method of driving a pixel circuit in accordance with an embodiment of the present invention. The waveforms of FIG. 3 are applied to a pixel circuit (e.g., 100 of FIG. 1, 130 of FIG. 2) having the drive circuit 104 of FIGS. 1 and 2.

The operation cycle of FIG. 3 includes a programming cycle 140 and a driving cycle 142. Referring to FIGS. 1 to 3, during the programming cycle 140, node A1 is charged to a programming voltage through the switch transistor 110 while the select line SEL is high. During the driving cycle 142, node A1 is discharged through the discharging transistor 108. Since the drive transistor 106 and the discharging transistor 108 have the same bias condition, they experience the same threshold voltage shift. Considering that the discharge time is a function of transconductance of the discharging transistor 108, the discharge time increases as the threshold voltage of the drive transistor 106/the discharging transistor 108 increases. Therefore, the average current of the pixel (100 of FIG. 1, 130 of FIG. 2) over the frame time remains constant. In an example, the discharging transistor is a very weak transistor with short width (W) and long channel length (L). The ratio of the width (W) to the length (L) may change based on different situations.

In addition, in the pixel circuit 130 of FIG. 2, an increase in the OLED voltage for the OLED 132 results in longer discharge time. Thus, the averaged pixel current will remain constant even after the OLED degradation.

Figure 4:
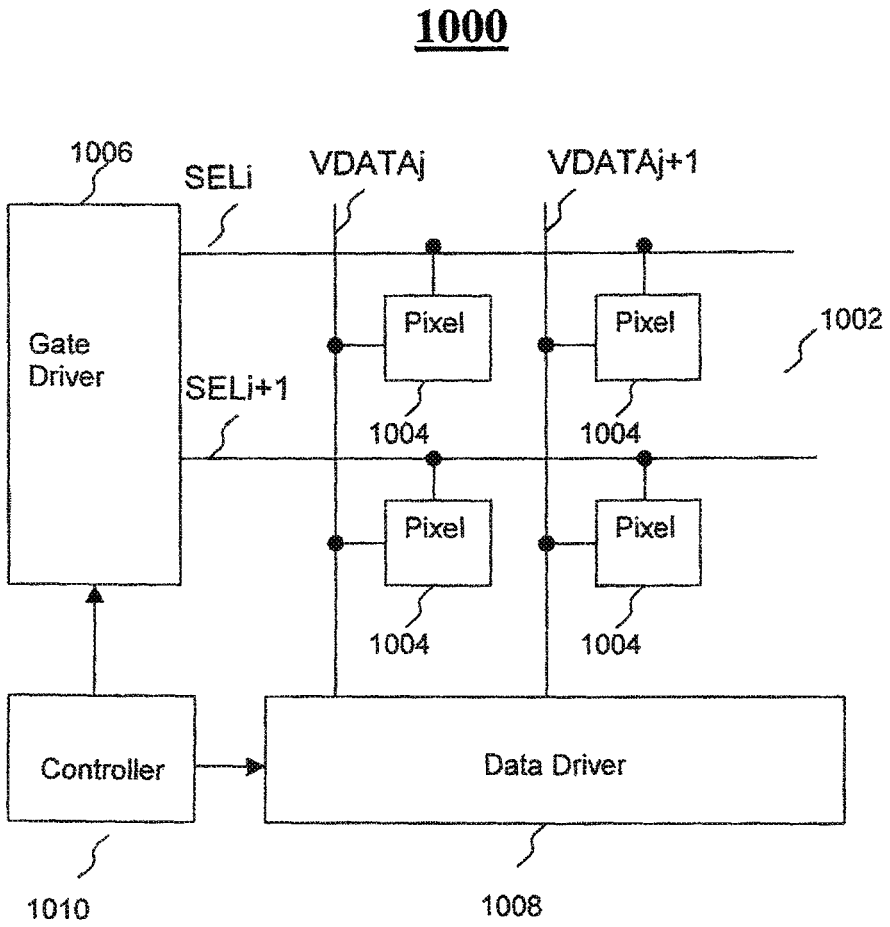
FIG. 4 is a diagram illustrating an example of a display system for the drive circuit of FIGS. 1 and 2.

FIG. 4 illustrates an example of a display system for the drive circuit of FIGS. 1 and 2. The display system 1000 of FIG. 4 includes a display array 1002 having a plurality of pixels 1004. The pixel 1004 includes the drive circuit 104 of FIGS. 1 and 2, and may be the pixel circuit 100 of FIG. 1 or the pixel circuit 130 of FIG. 2.

The display array 1002 is an active matrix light emitting display. In one example, the display array 1002 is an AMOLED display array. The display array 1002 may be a single color, multi-color or a fully color display, and may include one or more than one electroluminescence (EL) element (e.g., organic EL). The display array 1002 may be used in mobiles, personal digital assistants (PDAs), computer displays, or cellular phones.

Select lines SELi and SELi+1 and data lines VDATAj and VDATAj+1 are provided to the display array 1002. Each of the select lines SELi and SELi+1 corresponds to SEL of FIGS. 1 and 2. Each of the data lines VDATAj and VDATAj+1 corresponds to VDATA of FIGS. 1 and 2. The pixels 1004 are arranged in rows and columns. The select line (SELi, SELi+1) is shared between common row pixels in the display array 1002. The data line (VDATAj, VDATAj+1) is shared between common column pixels in the display array 1002.

In FIG. 4, four pixels 1004 are shown. However, the number of the pixels 1004 may vary in dependence upon the system design, and does not limited to four. In FIG. 4, two select lines and two data lines are shown. However, the number of the select lines and the data lines may vary in dependence upon the system design, and does not limited to two.

A gate driver 1006 drives SELi and SELi−1-1. The gate driver 1006 may be an address driver for providing address signals to the address lines (e.g., select lines). A data driver 1008 generates a programming data and drives VDATAj and VDATAj+1. A controller 1010 controls the drivers 1006 and 1008 to drive the pixels 1004 as described above.

Figure 5:
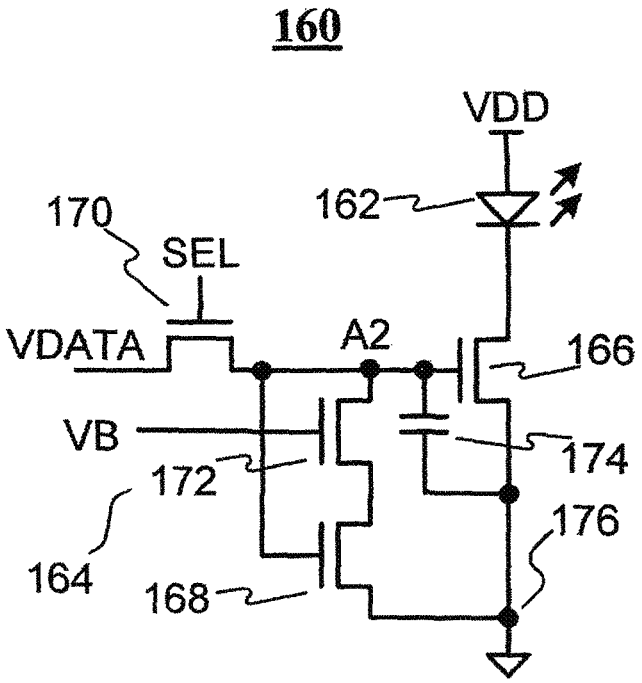
FIG. 5 is a diagram illustrating an example of a pixel circuit to which a pixel drive scheme in accordance with another embodiment of the present invention is applied.

FIG. 5 illustrates an example of a pixel circuit to which a pixel drive scheme in accordance with another embodiment of the present invention. The pixel circuit 160 of FIG. 5 includes an OLED 162 and a drive circuit 164 for driving the OLED 162. The drive circuit 164 includes a drive transistor 166, a discharging transistor 168, first and second switch transistors 170 and 172, and a storage capacitor 174.

The pixel circuit 160 is similar to the pixel circuit 130 of FIG. 2. The drive circuit 164 is similar to the drive circuit 104 of FIGS. 1 and 2. The transistors 166, 168 and 170 correspond to the transistors 106, 108 and 110 of FIGS. 1 and 2, respectively. The transistors 166, 168, and 170 may be same or similar to the transistors 106, 108 and 110 of FIGS. 1 and 2. The storage capacitor 174 corresponds to the storage capacitor 112 of FIGS. 1 and 2. The storage capacitor 174 may be same or similar to the storage capacitor 112 of FIGS. 1 and 2. The OLED 162 corresponds to the OLED 132 of FIG. 2. The OLED 162 may be same or similar to the OLED 132 of FIG. 2.

In one example, the switch transistor 172 is a n-type transistor. In another example, the switch transistor 172 is a p-type transistor. In one example, each of the transistors 166, 168, 170, and 172 includes a gate terminal, a source terminal and a drain terminal.

The transistors 166, 168, 170 and 172 may be fabricated using amorphous silicon, nano/micro crystalline silicon, poly silicon, organic semiconductors technologies (e.g., organic TFT), NMOS/PMOS technology or CMOS technology (e.g., MOSFET).

In the pixel circuit 160, the switch transistor 172 and the discharging transistor 168 are connected in series between the gate terminal of the drive transistor 166 and a power supply line (e.g., common ground) 176. The gate terminal of the switch transistor 172 is connected to a bias voltage line VB. The gate terminal of the discharging transistor 168 is connected to the gate terminal of the drive transistor at node AZ The drive transistor 166 is provided between one electrode (e.g., cathode electrode) of the OLED 162 and the power supply line 176. The gate terminal of the switch transistor 170 is connected to SEL. One terminal of the switch transistor 170 is connected to VDATA. The other terminal of the switch transistor 170 is connected to node A2. One terminal of the storage capacitor 174 is connected to node A2. The other terminal of the storage capacitor 174 is connected to the power supply line 176.

The pixel circuit 160 provides constant averaged current over the frame time by adjusting the gate voltage of the drive transistor 166, as described below.

Figure 6:
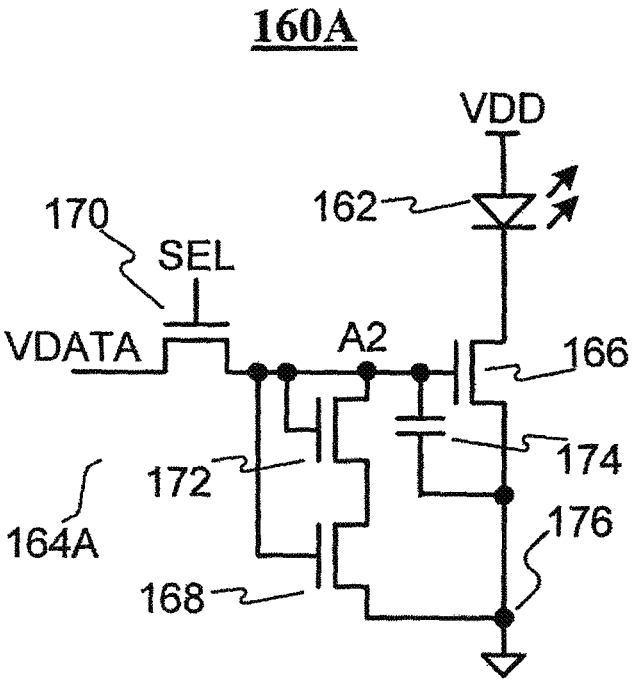
FIG. 6 is a diagram illustrating another example of a drive circuit of FIG. 5.
Figure 7:
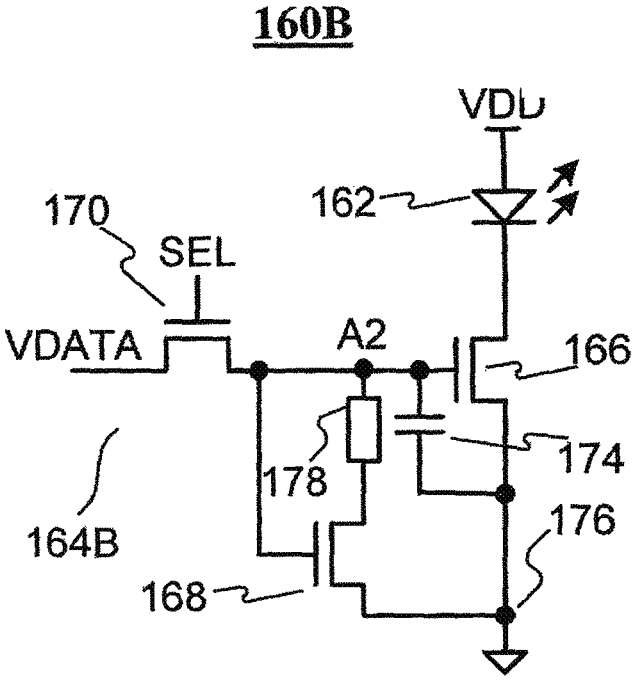
FIG. 7 is a diagram illustrating a further example of the drive circuit of FIG. 5.

In one example, the bias voltage line VB of FIG. 5 may be shared between the pixels of the entire panel, In another example, the bias voltage VB may be connected to node A2, as shown in FIG. 6, The pixel circuit 160A of FIG. 6 includes a drive circuit 164A. The drive circuit 164A is similar to the drive circuit 164 of FIG. 5. However, in the drive circuit 164A, the gate terminal of the switch transistor 172 is connected to node A2. In a further example, the switch transistor 172 of FIG. 5 may be replaced with a resistor, as shown in FIG. 7. The pixel circuit 160B of FIG. 7 includes a drive circuit 164B. The drive circuit 164B is similar to the drive circuit 164 of FIG. 5. However, in the drive circuit 164B, a resistor 178 and the discharging transistor 168 are connected in series between node A2 and the power supply line 176.

Figure 8:
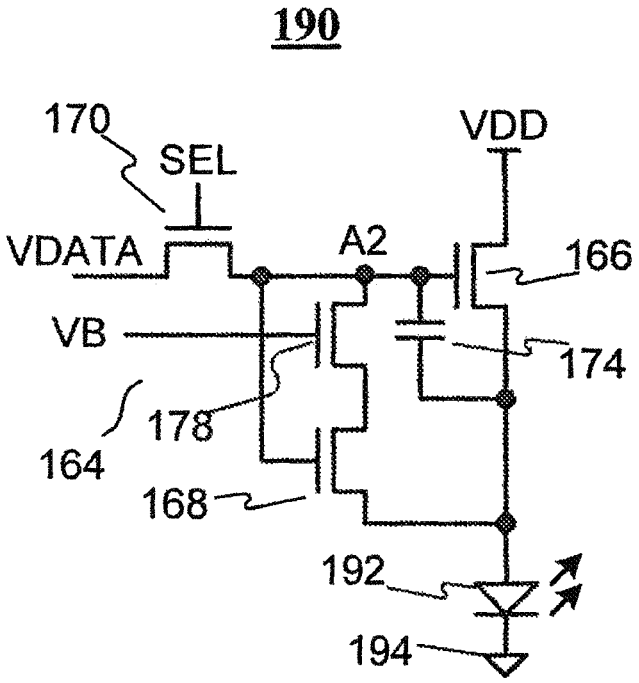
FIG. 8 is a diagram illustrating another example of a pixel circuit having the drive circuit of FIG. 5.

FIG. 8 illustrates another example of a pixel circuit having the drive circuit 164 of FIG. 5. The pixel circuit 190 is similar to the pixel circuit 160 of FIG. 5. The pixel circuit 190 includes an OLED 192. The OLED 192 may be same or similar to the OLED 162 of FIG. 5. In the pixel circuit 190, the drive transistor 166 is provided between one electrode (e.g., anode electrode) of the OLED 192 and VDD. One terminal of the discharging transistor 168 and one terminal of the storage capacitor 174 are connected to the OLED 192. The other electrode (e.g., cathode electrode) of the OLED 192 is connected to a power supply line (e.g., common ground) 194.

In one example, the bias voltage VB of FIG. 8 is shared between the pixels of the entire panel. In another example, the bias voltage VB of FIG. 8 is connected to node A2, as it is similar to that of FIG. 6. In a further example, the switch transistor 172 of FIG. 8 is replaced with a resistor, as it is similar to that of FIG. 7.

The pixel circuit 190 provides constant averaged current over the frame time, in a manner similar to that of the pixel circuit 160 of FIG. 5.

Figure 9:
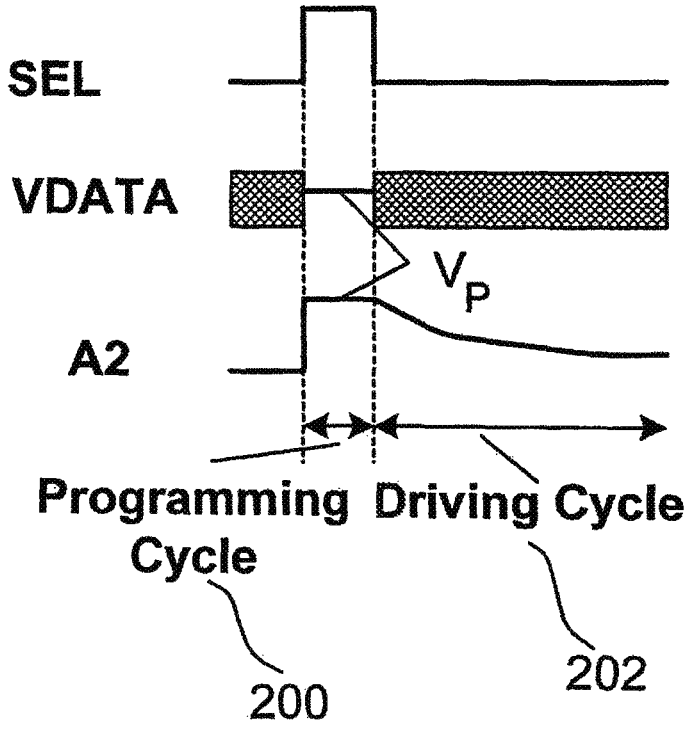
FIG. 9 is a timing diagram for an example of a method of driving a pixel circuit in accordance with another embodiment of the present invention.

FIG. 9 illustrates an example of method of driving a pixel circuit in accordance with another embodiment of the present invention. The waveforms of FIG. 9 are applied to a pixel circuit (e.g., 160 of FIG. 5, 190 of FIG. 8) having the drive circuit 164 of FIGS. 5 and 8.

The operation cycle of FIG. 9 includes a programming cycle 200 and a driving cycle 202. Referring to FIGS. 5, 8 and 9, during the programming cycle 200, node A2 is charged to a programming voltage (Vp) through the switch transistor 170 while SEL is high. During the driving cycle 202, node A2 is discharged through the discharging transistor 168, Since the drive transistor 166 and the discharging transistor 168 have the same bias condition, they experience the same threshold voltage shift Considering that the discharge time is a function of transconductance of the discharging transistor 168, the discharge time increases as the threshold voltage of the drive transistor 166/the discharging transistor 168 increases, Therefore, the average current of the pixel (160 of FIG. 5, 190 of FIG. 8) over the frame time remains constant. Here, the switch transistor 172 forces the discharging transistor 168 in the linear regime of operation, and so reduces feedback gain. Therefore, the discharging transistor 168 may be a unity transistor with the minimum channel length and width. The width and length of the unity transistor are the minimum allowed by the technology.

In addition, in the pixel circuit 190 of FIG. 8, an increase in the OLED voltage for the OLED 192 results in longer discharge time. Thus, the averaged pixel current will remain constant even after the OLED degradation.

Figure 10:
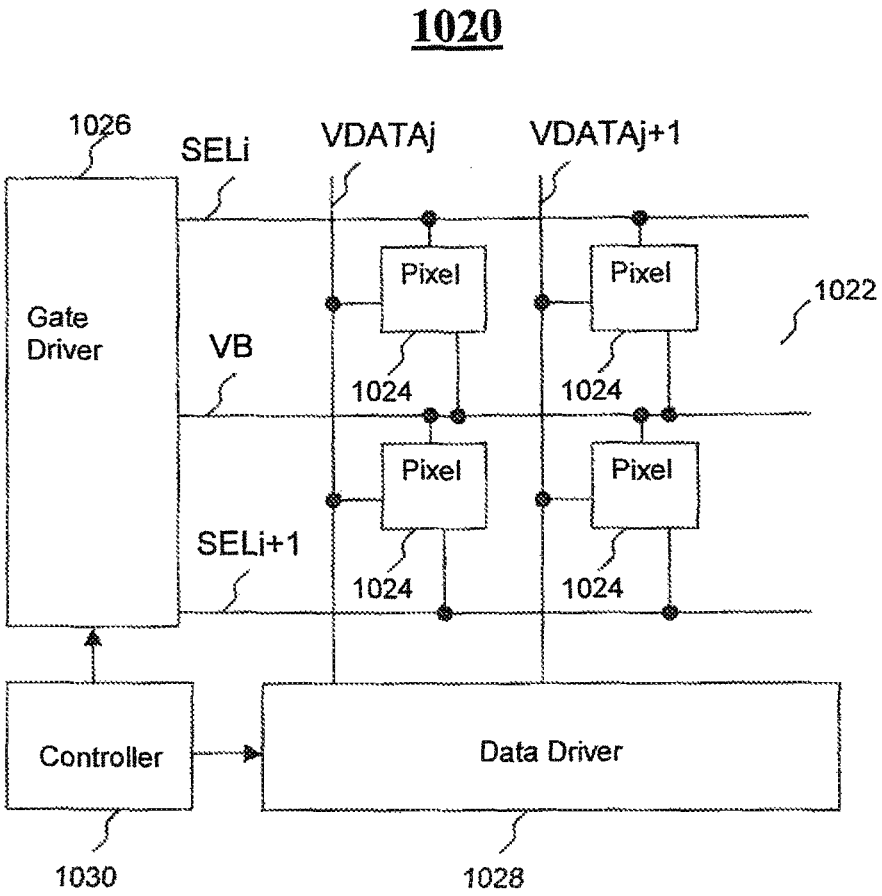
FIG. 10 is a diagram illustrating an example of a display system for the drive circuit of FIGS. 5 and 8.

FIG. 10 illustrates an example of a display system for the drive circuit of FIGS. 5 and 8. The display system 1020 of FIG. 10 includes a display array 1022 having a plurality of pixels 1024. The pixel 1024 includes the drive circuit 164 of FIGS. 5 and 8, and may be the pixel circuit 130 of FIG. 5 or the pixel circuit 190 of FIG. 8.

The display array 1022 is an active matrix light emitting display. In one example, the display array 1022 is an AMOLED display array. The display array 1022 may be a single color, multi-color or a fully color display, and may include one or more than one EL element (e.g., organic EL). The display array 1022 may be used in mobiles, PDAs, computer displays, or cellular phones, Each of select lines SELi and SELi+1 corresponds to SEL of FIGS. 5 and 8. VB corresponds to VB of FIGS. 5 and 8. Each of data lines VDATAj and VDATAj+1 corresponds to VDATA of FIGS. 5 and 8. The pixels 1024 are arranged in rows and columns. The select line (SELi, SEL1+1) is shared between common row pixels in the display array 1022. The data line (VDATAj, VDATAj+1) is shared between common column pixels in the display array 1022. The bias voltage line VB is shared by the ith and (i+1)th rows. In another—example, the VB may be shared by the entire array 1022.

In FIG. 10, four pixels 1024 are shown. However, the number of the pixels 1024 may vary in dependence upon the system design, and does not limited to four. In FIG. 10, two select lines and two data lines are shown. However, the number of the select lines and the data lines may vary in dependence upon the system design, and does not limited to two.

A gate driver 1026 drives SELi and SELi+1, and VB, The gate driver 1026 may include an address driver for providing address signals to the display array 1022. A data driver 1028 generates a programming data and drives VDATAj and VDATAj+1, A controller 1030 controls the drivers 1026 and 1028 to drive the pixels 1024 as described above.

Figure 11:
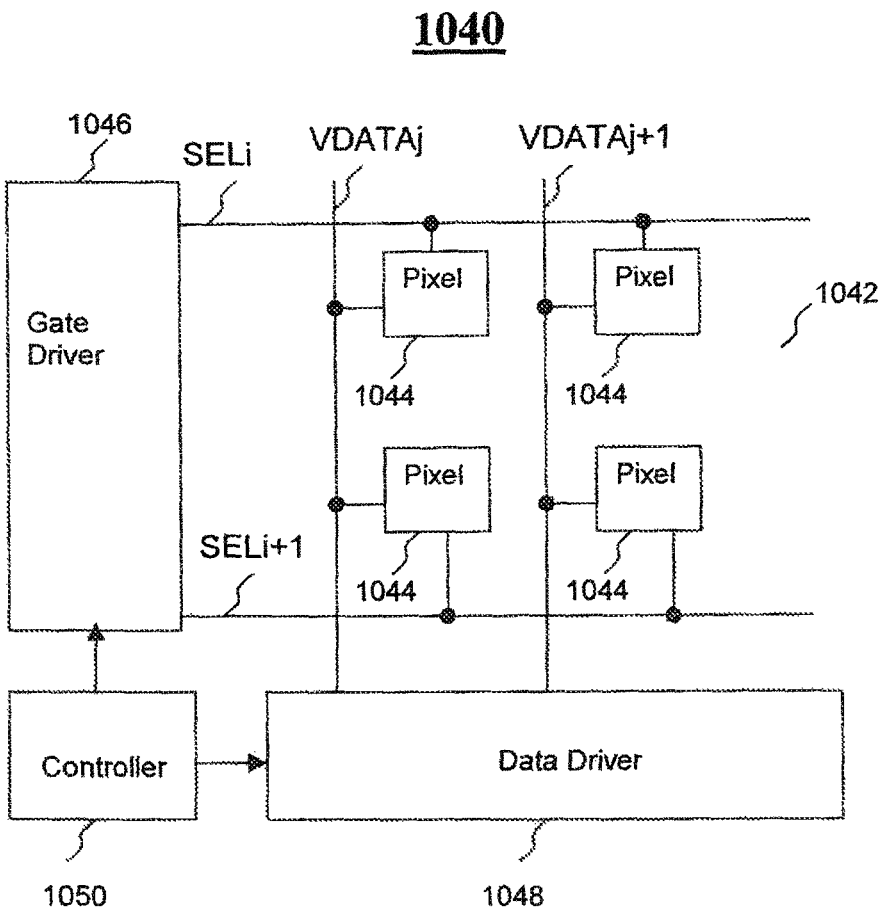
FIG. 11 is a diagram illustrating an example of a display system for the drive circuit of FIGS. 6 and 7.

FIG. 11 illustrates an example of a display system for the drive circuit of FIGS. 6 and 7. The display system 1040 of FIG. 11 includes a display array 1042 having a plurality of pixels 1044. The pixel 1044 includes the drive circuit 164A of FIG. 6 or 164B of FIG. 7, and may be the pixel circuit 160A of FIG. 6 or the pixel circuit 160B of FIG. 7.

The display array 1042 is an active matrix light emitting display, In one example, the display array 1042 is an AMOLED display array, The display array 1042 may be a single color, multi-color or a fully color display, and may include one or more than one EL element (e.g., organic EL). The display array 1042 may be used in mobiles, PDAs, computer displays, or cellular phones.

Each of select lines SELi and SELi+1 corresponds to SEL of FIGS. 6 and 7. Each of data lines VDATAj and VX)ATAj+1 corresponds to VDATA of FIGS. 6 and 7. The pixels 1044 are arranged in rows and columns The select line (SELL, SELi+1) is shared between common row pixels in the display array 1042, The data line (VDATAj, VDATAj+1) is shared between common column pixels in the display array 1042.

In FIG. 11, four pixels 1044 are shown. However, the number of the pixels 1044 may vary in dependence upon the system design, and does not limited to four. In FIG. 11, two select lines and two data lines are shown, However, the number of the select lines and the data lines may vary in dependence upon the system design, and does not limited to two.

A gate driver 1046 drives SELi and SELi±1. The gate driver 1046 may be an address driver for providing address signals to the address lines (e.g., select lines). A data driver 1048 generates a programming data and drives VDATAj and VDATAj+1, A controller 1040 controls the drivers 1046 and 1048 to drive the pixels 1044 as described above.

Figure 12:
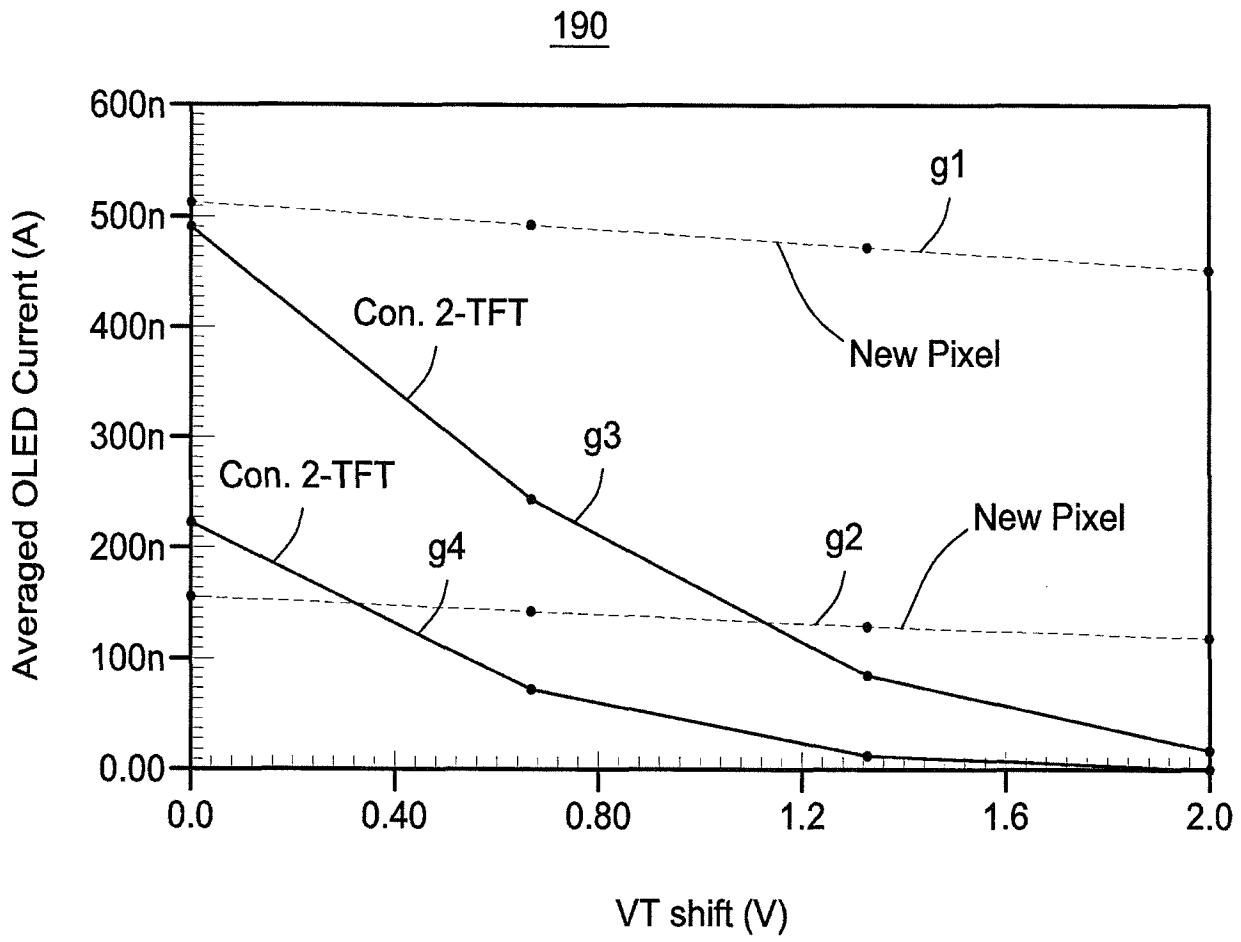
FIG. 12 is a graph illustrating simulation results for the pixel circuit of FIG. 1.

FIG. 12 illustrates simulation results for the pixel circuit 100 of FIG. 1. In FIG. 12, "g1" represents the current of the pixel circuit 100 presented in FIG. 1 for different shifts in the threshold voltage of the drive transistor 106 and initial current of 500 nA; "g2" represents the current of the pixel circuit 100 for different shifts in the threshold voltage of the drive transistor 106 and initial current of 150 nA. In FIG. 12, "g3" represents the current of a conventional 2-TFT pixel circuit for different shifts in the threshold voltage of a drive transistor and initial current of 500 nA; "g4" represents the current of the conventional 2-TFT pixel circuit for different shifts in the threshold voltage of a drive transistor and initial current of 150 nA. It is obvious that the averaged pixel current is stable for the new driving scheme whereas it drops dramatically if the discharging transistor (e.g., 106 of FIG. 1) is removed from the pixel circuit (conventional 2-TFT pixel circuit).

Figure 13:
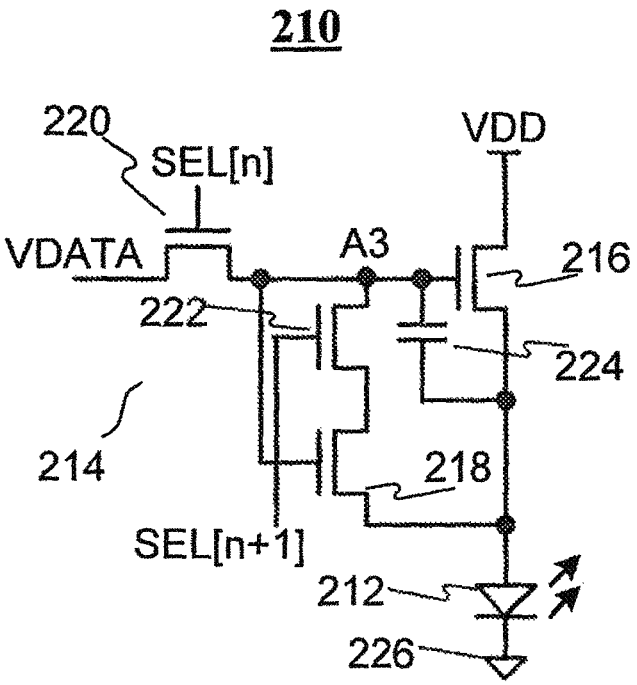
FIG. 13 is a diagram illustrating an example of a pixel circuit to which a pixel drive scheme in accordance with a further embodiment of the present invention is applied.

FIG. 13 illustrates an example of a pixel circuit to which a pixel drive scheme in accordance with a further embodiment of the present invention. The pixel circuit 210 of FIG. 13 includes an OLED 212 and a drive circuit 214 for driving the OLED 212. The drive circuit 214 includes a drive transistor 216, a discharging transistor 218, first and second switch transistors 220 and 222, and a storage capacitor 224.

The pixel circuit 210 is similar to the pixel circuit 190 of FIG. 8. The drive circuit 214 is similar to the drive circuit 164 of FIGS. 5 and 8, The transistors 216, 218 and 220 correspond to the transistors 166, 168 and 170 of FIGS. 5 and 8, respectively. The transistors 216, 218, and 220 may be same or similar to the transistors 166, 168, and 170 of FIGS. 5 and 8. The transistor 222 may be same or similar to the transistor 172 of FIG. 5 or the transistor 178 of FIG. 8. In one example, each of the transistors 216, 218, 220, and 222 includes a gate terminal, a source terminal and a drain terminal, The storage capacitor 224 corresponds to the storage capacitor 174 of FIGS. 5 to 8. The storage capacitor 224 may be same or similar to the storage capacitor 174 of FIGS. 5 to 8, The OLED 212 corresponds to the OLED 192 of FIG. 8. The OLED 212 may be same or similar to the OLED 192 of FIG. 8.

The transistors 216, 218, 220, and 222 may be fabricated using amorphous silicon, nano/micro crystalline silicon, poly silicon, organic semiconductors technologies (e.g., organic TF1), NMOS/PMOS technology or CMOS technology (e.g., MOSFET).

In the pixel circuit 210, the drive transistor 216 is provided between VDD and one electrode (e.g., anode electrode) of the OLED 212. The switch transistor 222 and the discharging transistor 218 are connected in series between the gate terminal of the drive transistor 216 and the OLED 212. One terminal of the switch transistor 222 is connected to the gate terminal of the drive transistor at node A3. The gate terminal of the discharging transistor 218 is connected to node M. The storage capacitor 224 is provided between node A3 and the OLED 212. The switch transistor 220 is provided between VDATA and node A3. The gate terminal of the switch transistor 220 is connected to a select line SEL[n]. The gate terminal of the switch transistor 222 is connected to a select line SEL [n+1]. The other electrode (e.g., cathode electrode) of the OLED 212 is connected to a power supply line (e.g., common ground) 226. In one example, SEL [n] is the address line of the nth row in a display array, and SEL[n+1] is the address line of the (n+1)th row in the display array.

The pixel circuit 210 provides constant averaged current over the frame time by adjusting the gate voltage of the drive transistor 216, as described below.

Figure 14:
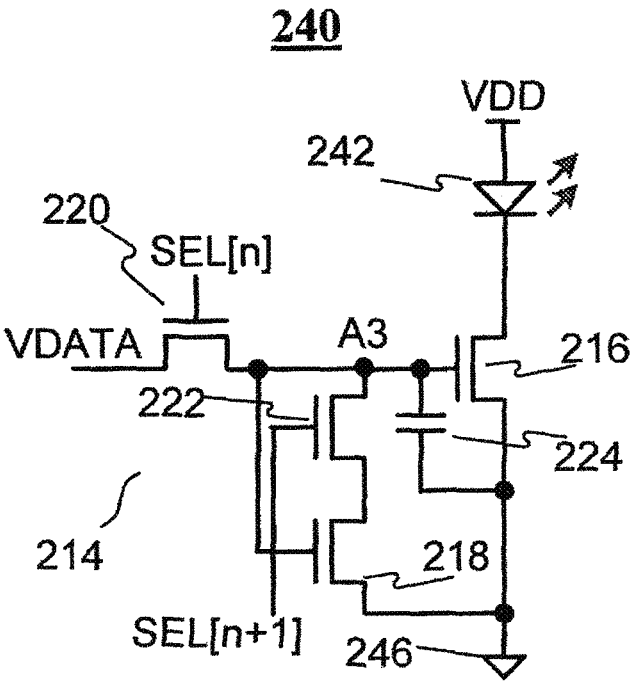
FIG. 14 is a diagram illustrating another example of a pixel circuit having a drive circuit of FIG. 13.

FIG. 14 illustrates another example of a pixel circuit having the drive circuit 214 of FIG. 13. The pixel circuit 240 of FIG. 14 is similar to the pixel circuit 160 of FIG. 5. The pixel circuit 240 includes an OLED 242. The OLED 242 may be same or similar to the OLED 162 of FIG. 5, Tn the pixel circuit 240, the drive transistor 216 is provided between one electrode (e.g., cathode electrode) of the OLED 242 and a power supply line (e.g., common ground) 246. One terminal of the discharging transistor 218 and one terminal of the storage capacitor 224 are connected to the power supply line 246. The other electrode (e.g., anode electrode) of the OLED 242 is connected to VDD. The gate terminal of the switch transistor 220 is connected to the select line SEL[n]. The gate terminal of the switch transistor 222 is connected to the select line SEL [n+1].

The pixel circuit 240 provides constant averaged current over the frame time, in a manner similar to that of the pixel circuit 210 of FIG. 13.

Figure 15:
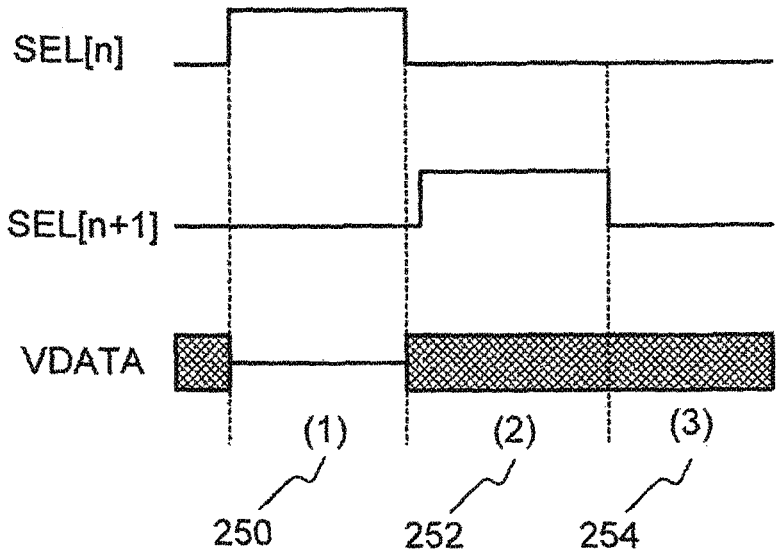
FIG. 15 is a timing diagram for an example of a method of driving a pixel circuit in accordance with a further embodiment of the present invention.

FIG. 15 illustrates an example of method of driving a pixel circuit in accordance with an embodiment of the present invention. The waveforms of FIG. 15 are applied to a pixel circuit (e.g., 210 of FIG. 13, 240 of FIG. 14) having the drive circuit 214 of FIGS. 13 and 14.

The operation cycles of FIG. 15 include three operation cycles 250, 252 and 254. The operation cycle 250 forms a programming cycle, the operation cycle 252 forms a compensation cycle, and the operation cycle 254 forms a driving cycle. Referring to FIGS. 13 to 15, during the programming cycle 250, node A3 is charged to a programming voltage through the switch transistor 220 while SEL[n] is high. During the second operating cycle 252 SEL[n+1] goes to a high voltage. SEL[n] is disenabled (or deactivated). Node A3 is discharged through the discharging transistor 218, During the third operating cycle 254, SEL[n] and SEL[n+1] are disenabled. Since the drive transistor 216 and the discharging transistor 218 have the same bias condition, they experience the same threshold voltage shift. Considering that the discharge time is a function of transconductance of the discharging transistor 218, the discharged voltage decreases as the threshold voltage of the drive transistor 216/the discharging transistor 218 increases. Therefore, the gate voltage of the drive transistor 216 is adjusted accordingly.

Figure 16:
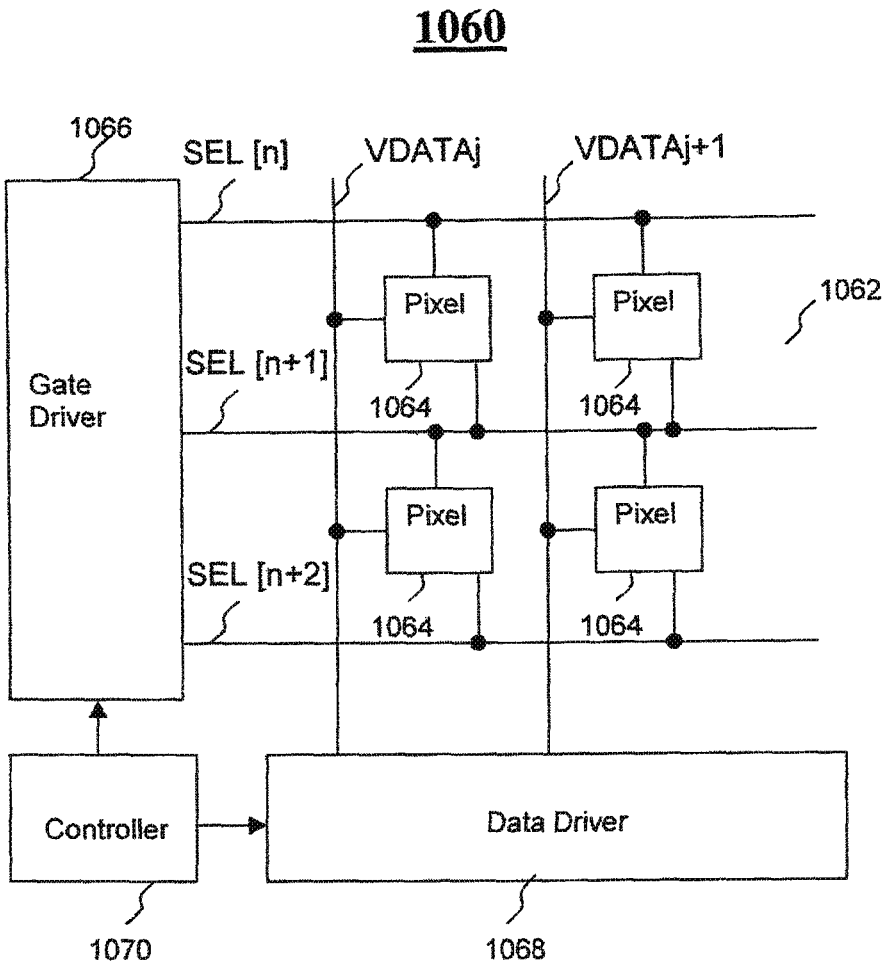
FIG. 16 is a diagram illustrating an example of a display system for the drive circuit of FIGS. 13 and 14.

In addition, in the pixel 240 of FIG. 14, an increase in the OLED voltage for the OLED 242 results in higher gate voltage. Thus, the pixel current remains constant FIG. 16 illustrates an example of a display system for the drive circuit of FIGS. 13 and 14. The display system 1060 of FIG. 16 includes a display array 1062 having a plurality of pixels 1064. The pixel 1064 includes the drive circuit 214 of FIGS. 13 and 14, and may be the pixel circuit 210 of FIG. 13 or the pixel circuit 240 of FIG. 14.

The display array 1062 is an active matrix light emitting display. In one example, the display array 1062 is an AMOLED display array. The display array 1062 may be a single color, multi-color or a fully color display, and may include one or more than one EL element (e.g., organic EL), The display array 1062 may be used in mobiles, PDAs, computer displays, or cellular phones.

SEL[k] (k=n+1, n+2) is an address line for the kth row. VDATAI (1=j, j+1) is a data line and corresponds to VDATA of FIGS. 13 and 14. The pixels 1064 are arranged in rows and columns. The select line SEL[k] is shared between common row pixels in the display array 1062. The data line VDATAI is shared between common column pixels in the display array 1062.

In FIG. 16, four pixels 1064 are shown. However, the number of the pixels 1064 may vary in dependence upon the system design, and does not limited to four. In FIG. 16, three address lines and two data lines are shown. However, the number of the address lines and the data lines may vary in dependence upon the system design.

A gate driver 1066 drives SEL[k]. The gate driver 1066 may be an address driver for providing address signals to the address lines (e.g., select lines). A data driver 1068 generates a programming data and drives VDATA1. A controller 1070 controls the drivers 1066 and 1068 to drive the pixels 1064 as described above.

Figure 17:
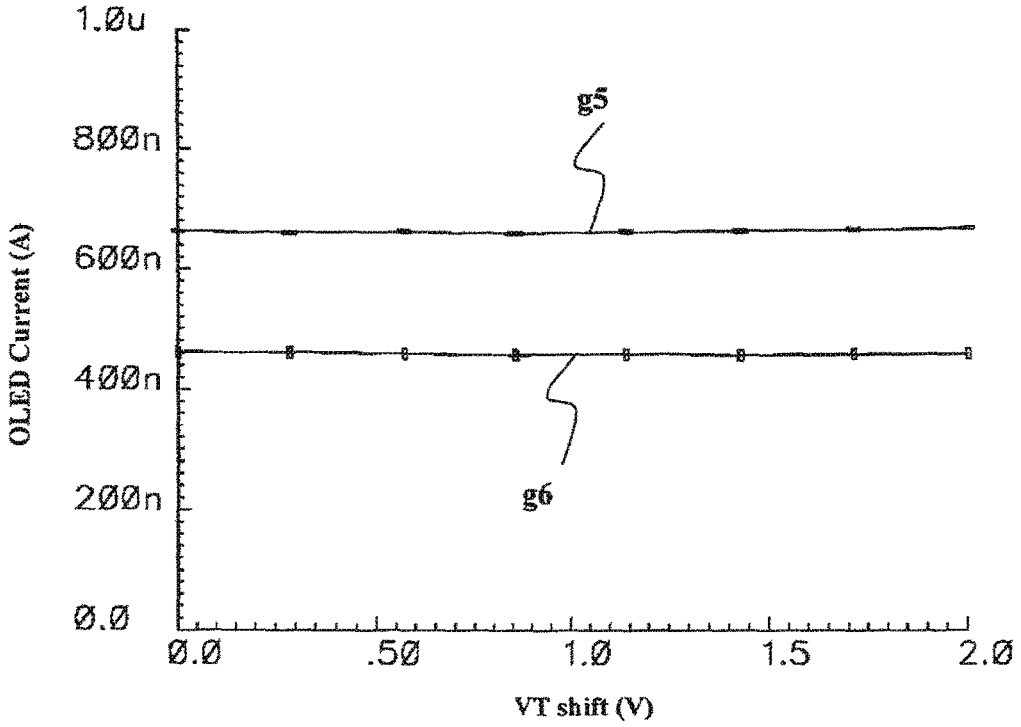
FIG. 17 is a graph illustrating simulation results for the pixel circuit of FIG. 5.

FIG. 17 illustrates the simulation results for the pixel circuit 160 of FIG. 5, In FIG. 17, "g5" represents the current of the pixel circuit 160 presented in FIG. 5 for different shifts in the threshold voltage of the drive transistor 166 and initial current of 630 nA; "g6" represents the current of the pixel circuit 160 for different shifts in the threshold voltage of the drive transistor 166 and initial current of 430 nA. It is seen that the pixel current is highly stable even after a 2-V shift in the threshold voltage of the drive transistor. Since the pixel circuit 210 of FIG. 13 is similar to the pixel circuit 160 of FIG. 15, it is apparent to one of ordinary skill in the art that the pixel current of the pixel circuit 210 will be also stable.

Figure 18:
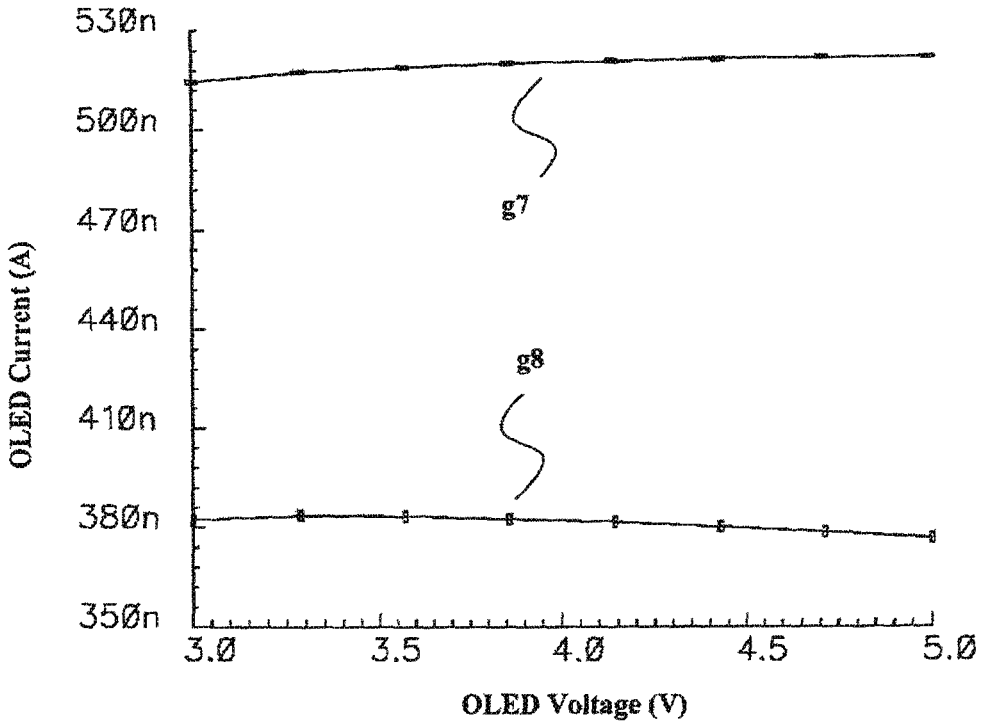
FIG. 18 is a graph illustrating simulation results for the pixel circuit of FIG. 5.

FIG. 18 illustrates the simulation results for the pixel circuit 160 of FIG. 5. In FIG. 18, "g7" represents the current of the pixel circuit 160 presented in FIG. 5 for different OLED voltages of the drive transistor 166 and initial current of 515 nA; "g8" represents the current of the pixel circuit 160 for different OLED voltages of the drive transistor 166 and initial current of 380 nA, It is seen that the pixel current is highly stable even after a 2-V shift in the voltage of the OLED. Since the pixel circuit 210 of FIG. 13 is similar to the pixel circuit 160 of FIG. 15, it is apparent to one of ordinary skill in the art that the pixel current of the pixel circuit 210 will be also stable.

Figure 19:
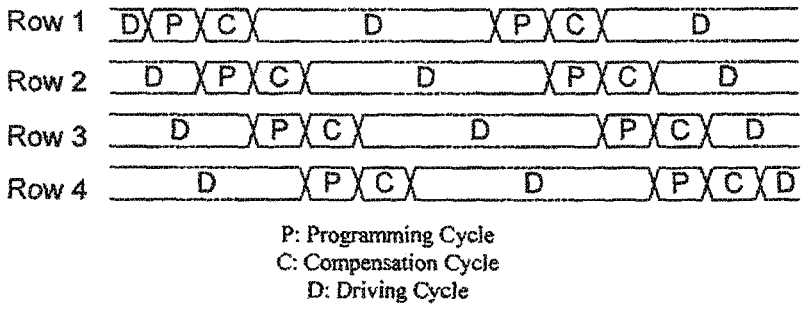
FIG. 19 is a timing diagram for the operation of the display system of FIG. 16.

FIG. 19 is a diagram showing programming and driving cycles for driving the display arrays 1062 of FIG. 16. In FIG. 16, each of ROW j (j=1, 2, 3, 4) represents the jth row of the display array 1062. In FIG. 19, "P" represents a programming cycle; "C" represents a compensation cycle; and "D" represents a driving cycle. The programming cycle P at the jth Row overlaps with the driving cycle D at the (j+1)th Row. The compensation cycle C at the jth Row overlaps with the programming cycle P at the (1+1)th Row. The driving cycle D at the jth Row overlaps with the compensation cycle C at the (j+1)th Row.

Figure 20:
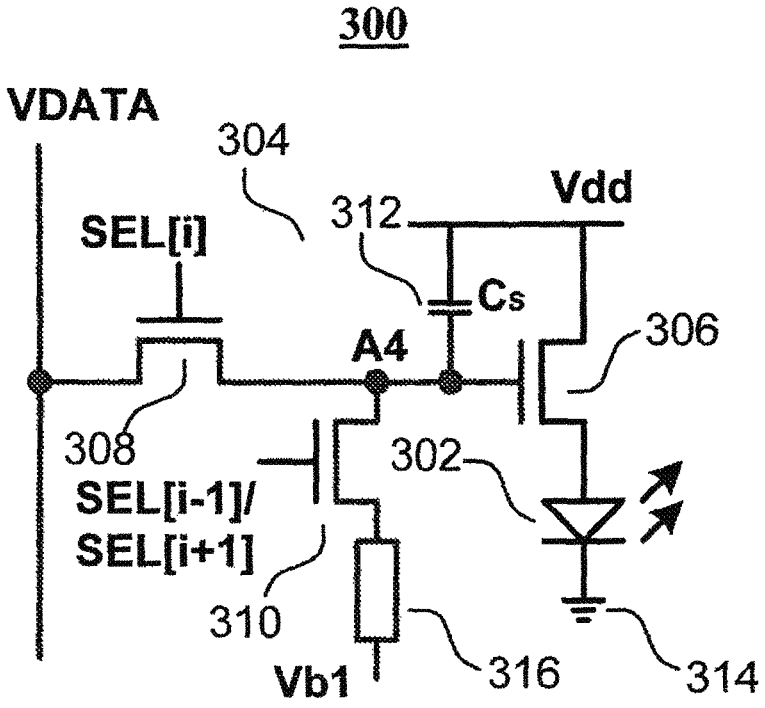
FIG. 20 is a diagram illustrating an example of a pixel circuit to which a pixel drive scheme in accordance with a further embodiment of the present invention is applied.

FIG. 20 illustrates an example of a pixel circuit to which a pixel drive scheme in accordance with a further embodiment of the present invention is applied. The pixel circuit 300 of FIG. 20 includes an OLED 302 and a drive circuit 304 for driving the OLED 302. The drive circuit 304 includes a drive transistor 306, a switch transistor 308, a discharging transistor 310, and a storage capacitor 312. The OLED 302 includes, for example, an anode electrode, a cathode electrode and an emission layer between the anode electrode and the cathode electrode.

In one example, the transistors 306, 308 and 310 are n-type transistors. In another example, the transistors 306, 308 and 310 are p-type transistors or a combination of n-type and p-type transistors. In one example, each of the transistors 306, 308 and 310 includes a gate terminal, a source terminal and a drain terminal. The transistors 306, 308 and 310 may be fabricated using amorphous silicon, nano/micro crystalline silicon, poly silicon, organic semiconductors technologies (e.g., organic TFT), NMOS/PMOS technology or CMOS technology (e.g., MOSFET).

The drive transistor 306 is provided between a voltage supply line Vdd and the OLED 302. One terminal (e.g., source) of the drive transistor 306 is connected to Vdd. The other terminal (e.g., drain) of the drive transistor 306 is connected to one electrode (e.g., anode electrode) of the OLED 302. The other electrode (e.g., cathode electrode) of the OLED 302 is connected to a power supply line (e.g., common ground) 314. One terminal of the storage capacitor 312 is connected to the gate terminal of the drive transistor 306 at node A4. The other terminal of the storage capacitor 312 is connected to Vdd. The gate terminal of the switch transistor 308 is connected to a select line SEL M. One terminal of the switch transistor 308 is connected to a data line VDATA. The other terminal of the switch transistor 308 is connected to node A4. The gate terminal of the discharging transistor 310 is connected to a select line SEL [i−1] or SEL[i+1]. In one example, the select line SEL[m] (m=i−1, i, 1+1) is an address line for the mth row in a display array. One terminal of the discharging transistor 310 is connected to node A4. The other terminal of the discharging transistor 310 is connected to a sensor 316. In one example, each pixel includes the sensor 316. In another example, the sensor 316 is shared by a plurality of pixel circuits.

The sensor 316 includes a sensing terminal and a bias terminal Vb1, The sensing terminal of the sensor 316 is connected to the discharging transistor 310. The bias terminal Vb1 may be connected, for example, but not limited to, ground, Vdd or the one terminal (e.g., source) of the drive transistor 306. The sensor 316 detects energy transfer from the pixel circuit. The sensor 316 has a conductance that varies in dependence upon the sensing result, The emitted light or thermal energy by the pixel absorbed by the sensor 316 and so the carrier density of the sensor changes. The sensor 316 provides feedback by, for example, but not limited to, optical, thermal or other means of transduction. The sensor 316 may be, but not limited to, an optical sensor or a thermal sensor. As described below, node A4 is discharged in dependence upon the conductance of the sensor 316.

The drive circuit 304 is used to implement programming, compensating/calibrating and driving of the pixel circuit. The pixel circuit 300 provides constant luminance over the lifetime of its display by adjusting the gate voltage of the drive transistor 306.

Figure 21:
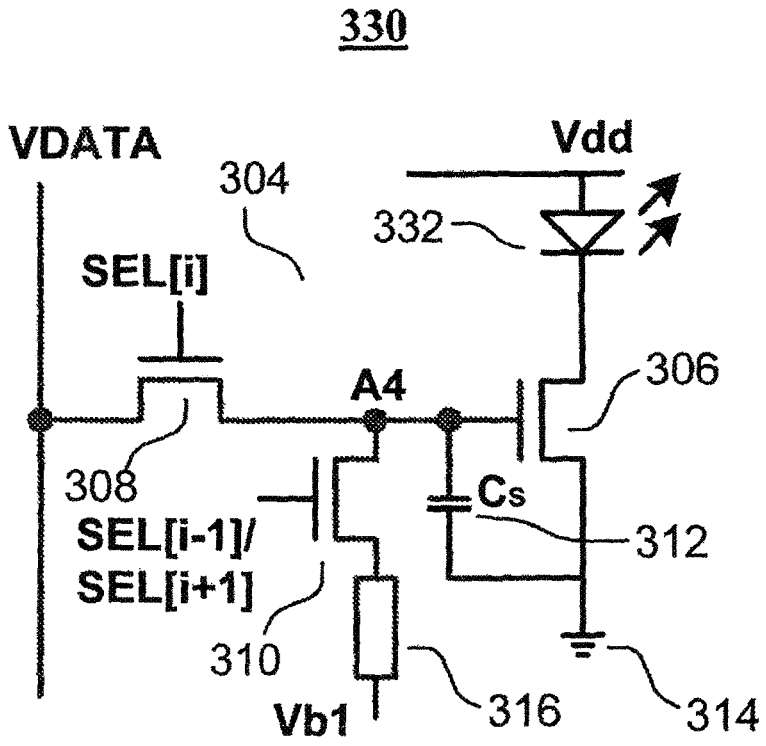
FIG. 21 is a diagram illustrating another example of a pixel circuit having the drive circuit of FIG. 20.

FIG. 21 illustrates another example of a pixel circuit having the drive circuit 304 of FIG. 20. The pixel circuit 330 of FIG. 21 is similar to the pixel circuit 300 of FIG. 20. The pixel circuit 330 includes an OLED 332. The OLED 332 may be same or similar to the OLED 302 of FIG. 20. In the pixel circuit 330, one terminal (e.g., drain) of the drive transistor 306 is connected to one electrode (e.g., cathode electrode) of the OLED 332, and the other terminal (e.g., source) of the drive transistor 306 is connected to a power supply line (e.g., common ground) 334. In addition, one terminal of the storage capacitor 312 is connected to node A4, and the other terminal of the storage capacitor 312 is connected to the power supply line 334. The pixel circuit 330 provides constant luminance over the lifetime of its display, in a manner similar to that of the pixel circuit 300 of FIG. 20.

Referring to FIGS. 20 and 21, the aging of the drive transistor 306 and the OLED 302/332 in the pixel circuit are compensated in two different ways: in-pixel compensation and of-panel calibration.

Figure 22:
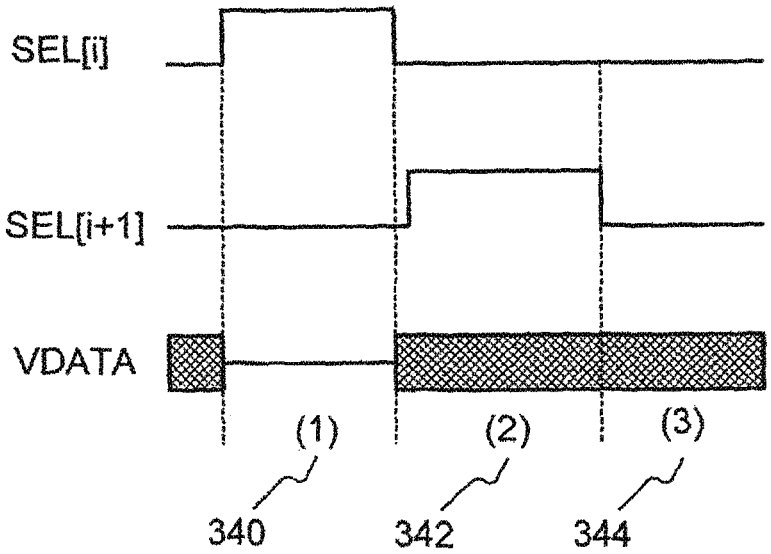
FIG. 22 is a timing diagram illustrating an example of a method of driving a pixel circuit in accordance with a further embodiment of the present invention.

In-pixel compensation is descried in detail. FIG. 22 illustrates an example of a method of driving a pixel circuit in accordance with a further embodiment of the present invention. By applying the waveforms of FIG. 22 to a pixel having the drive circuit 304 of FIGS. 20 and 21, the in-pixel compensation is implemented.

The operation cycles of FIG. 22 include three operation cycles 340, 342 and 344. The operation cycle 340 is a programming cycle of the ith row and is a driving cycle for the (i+1)th row. The operation cycle 342 is a compensation cycle for the ith row and is a programming cycle of the (i+1)th row. The operation cycle 344 is a driving cycle for the ith row and is a compensation cycle for the (i+1)th row.] Referring to FIGS. 20 to 22, during the programming cycle 340 for the ith row of a display, node A4 of the pixel circuit in the ith row is charged to a programming voltage through the switch transistor 308 while the select line SEL[i] is high. During the programming cycle 342 for the (i+1)th row, SEL[i+1] goes high, and the voltage stored at node A4 changes based on the conductance of the sensor 316. During the driving cycle 344 of the ith row, the current of the drive transistor 306 controls the OLED luminance.

The amount of the discharged voltage at node A4 depends on the conductance of the sensor 316. The sensor 316 is controlled by the OLED luminance or temperature. Thus, the amount of the discharged voltage reduces as the pixel ages. This results in constant luminance over the lifetime of the pixel circuit.

Figure 23:
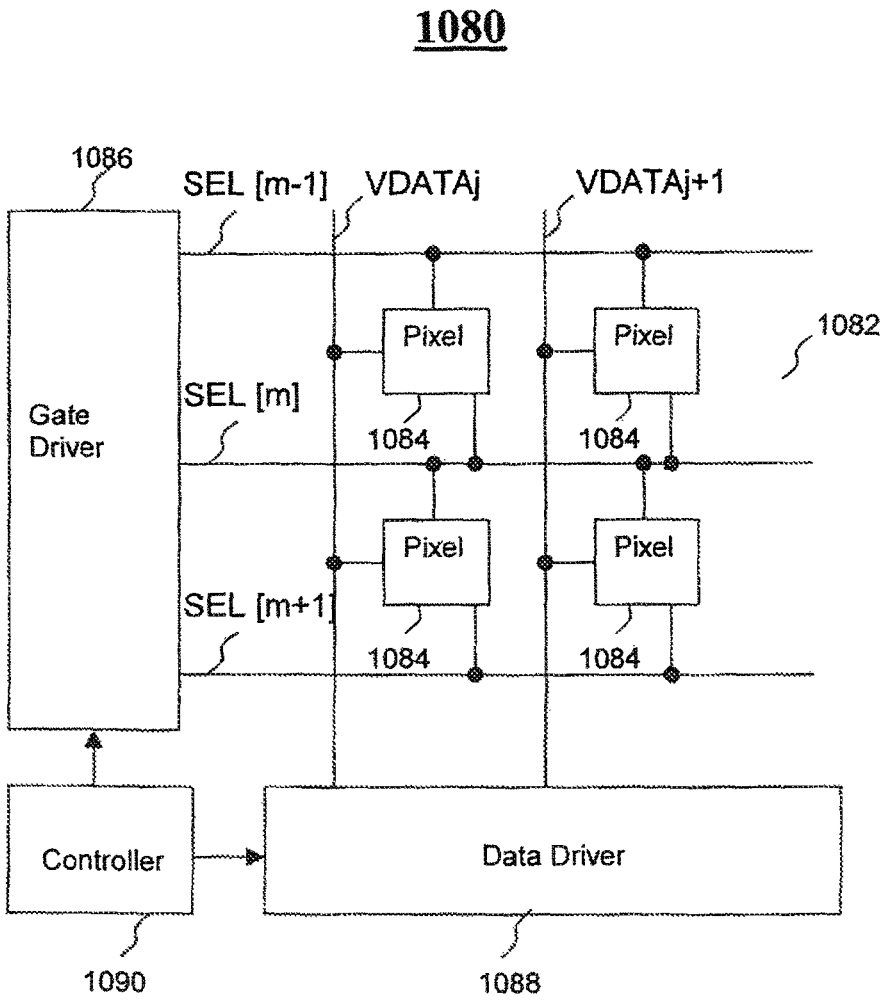
FIG. 23 is a diagram illustrating an example of a display system for the drive circuit of FIGS. 20 and 21.

FIG. 23 illustrates an example of a display system for the drive circuit 304 of FIGS. 20 and 21. The display system 1080 of FIG. 23 includes a display array 1082 having a plurality of pixels 1084. The pixel 1084 includes the drive circuit 304 of FIGS. 20 and 21, and may be the pixel circuit 300 of FIG. 20 or the pixel circuit 330 of FIG. 21.

The display array 1082 is an active matrix light emitting display. In one example, the display array 1082 is an AMOLED display array. The display array 1082 may be a single color, multi-color or a fully color display, and may include one or more than one electroluminescence (EL) element (e.g., organic EL). The display array 1082 may be used in mobiles, personal digital assistants (PDAs), computer displays, or cellular phones.

SEL[i] (i=m−1, m, m+1) in FIG. 23 is an address line for the ith row. VDATAn j+1) in FIG. 23 is a data line for the nth column. The address line SEL[i] correspond to the select line SEL[i] of FIGS. 20 and 21. The data line VDATAn corresponds to VDATA of FIGS. 20 and 21.

A gate driver 1086 includes an address driver for providing an address signal to each address line to drive them. A data driver 1088 generates a programming data and drives the data line. A controller 1090 controls the drivers 1086 and 1088 to drive the pixels 1084 and implement the in-pixel compensation as described above.

In FIG. 23, four pixels 1084 are shown. However, the number of the pixels 1084 may vary in dependence upon the system design, and does not limited to four. In FIG. 23, three address lines and two data lines are shown. However, the number of the select lines and the data lines may vary in dependence upon the system design.

In FIG. 23, each of the pixels 1084 includes the sensor 316 of FIGS. 20 and 21. In another example, the display array 1080 may include one or more than one reference pixel having the sensor 316, as shown in FIG. 24.

Figure 24:
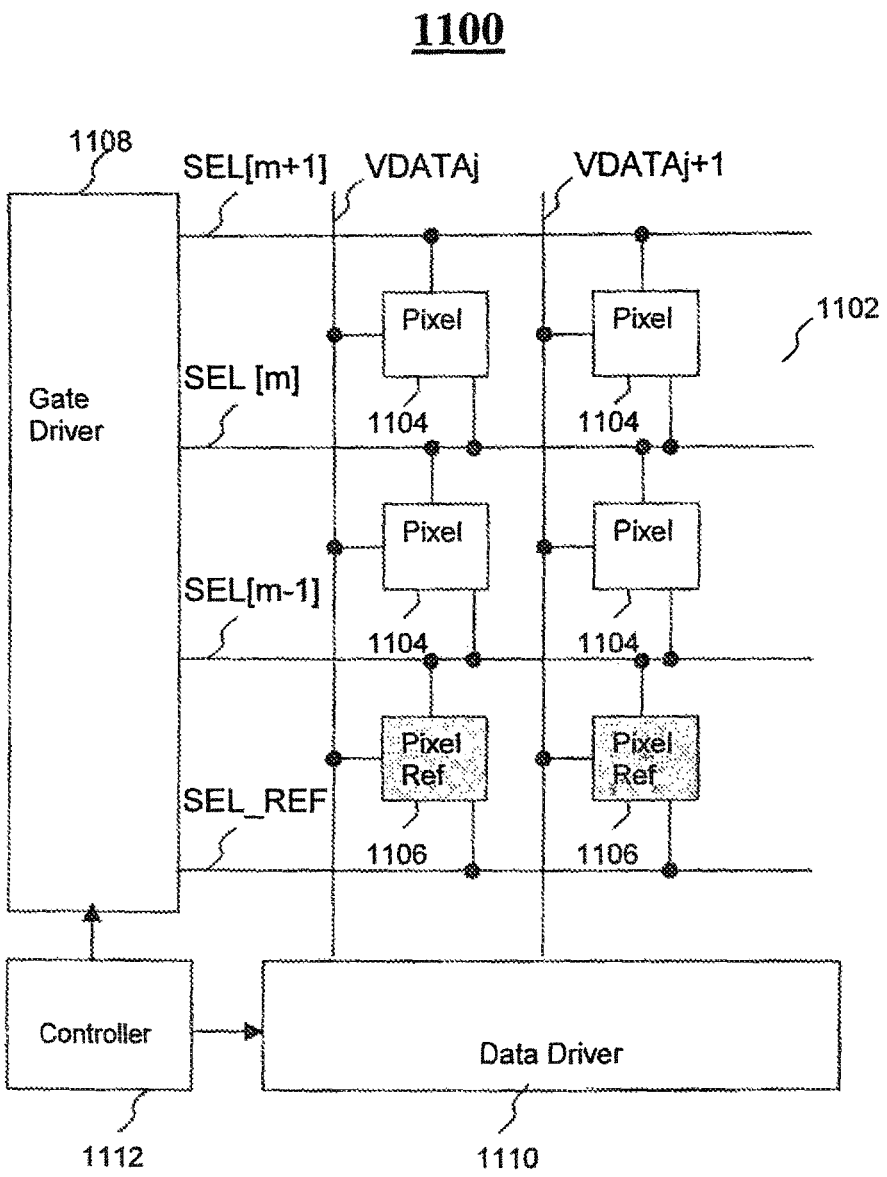
FIG. 24 is a diagram illustrating another example of a display system for the drive circuit of FIGS. 20 and 21.

FIG. 24 illustrates another example of a display system for the drive circuit 304 of FIGS. 20 and 21. The display system 1100 of FIG. 24 includes a display array 1102 having a plurality of pixels 1104 and one or more than one reference pixels 1106. The reference pixel 1106 includes the drive circuit 304 of FIGS. 20 and 21, and may be the pixel circuit 300 of FIG. 20 or the pixel circuit 330 of FIG. 21. In FIG. 24, two reference pixels 1106 are shown. However, the number of the pixels 1084 may vary in dependence upon the system design, and does not limited to two. The pixel 1104 includes an OLED and a drive transistor for driving the OLED, and does not include the sensor 316 of FIGS. 20 and 21. SEL_REF is a select line for selecting the discharging transistors in the array of the reference pixels 1106.

A gate driver 1108 drives the address lines and the select line SEL_REF. The gate driver 1108 may be same or similar to the gate driver 1108 of FIG. 24. A data driver 1110 drives the data lines. The data driver 1110 may be same or similar to the data driver 1088 of FIG. 23. A controller 1112 controls the drivers 1108 and 1110.

The reference pixels of FIGS. 23 and 24 (1084 of FIG. 23, 1106 of FIG. 24) may be operated to provide aging knowledge for an of-panel algorithm in which the programming voltage is calibrated at the controller (1090 of FIG. 23, 1112 of FIG. 24) or driver side (1088 of FIG. 23, 1110 of FIG. 24) as described below.

Of-panel calibration is descried in detail. Referring to FIG. 21, the of-panel calibration is implemented by extracting the aging of the pixel circuit by reading back the sensor 316, and calibrating the programming voltage. The of-panel calibration compensates for the pixel aging including the threshold Vt shift and OLED degradation.

Figure 25:
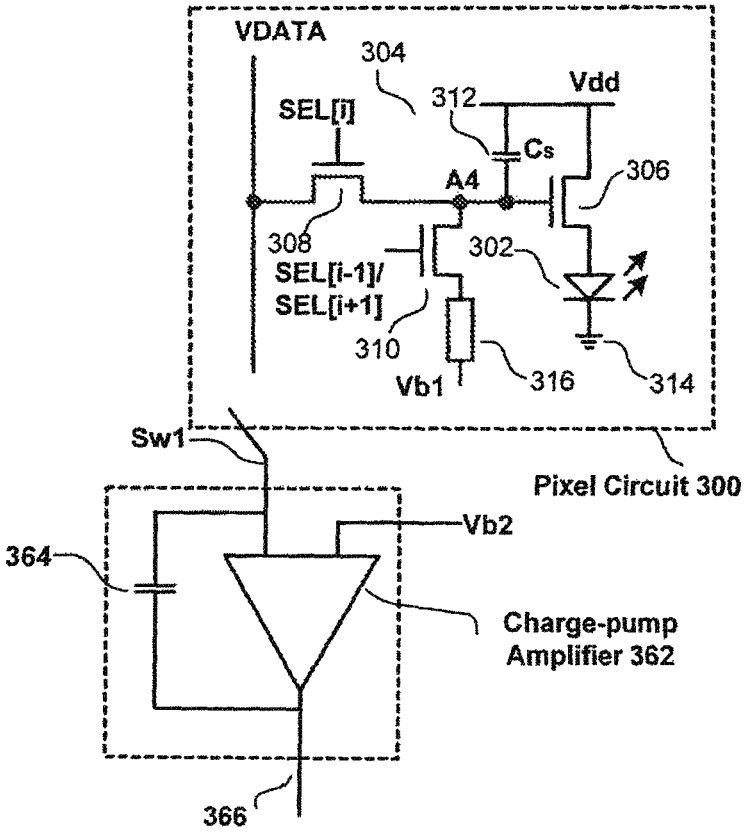
FIG. 25 is a diagram illustrating an example of a pixel system in accordance with as embodiment of the present invention.

FIG. 25 illustrates an example of a pixel system in accordance with an embodiment of the present invention. The pixel system of FIG. 25 includes a read back circuit 360. The read back circuit 360 includes a charge-pump amplifier 362 and a capacitor 364. One terminal of the charge-pump amplifier 362 is connectable to the data line VDATA via a switch SW1. The other terminal of the charge-pump amplifier 362 is connected to a bias voltage Vb2. The charge-pump amplifier 362 reads back the voltage discharged from the node A4 via the switch SW1.

The output 366 of the charge pump amplifier 362 varies in dependent upon the voltage at node A4. The time depending characteristics of the pixel circuit is readable from node A4 via the charge-pump amplifier 362.

In FIG. 25, one read back circuit 360 and one switch SW1 are illustrated for one pixel circuit. However, the read back circuit 360 and the switch SW1 may be provided for a group of pixel circuits (e,g., pixel circuits in a column). In FIG. 25, the read back circuit 360 and the switch SW1 are provided to the pixel circuit 300. In another example, the read back circuit 360 and the switch SW1 are applied to the pixel circuit 330 of FIG. 21.

Figure 26:
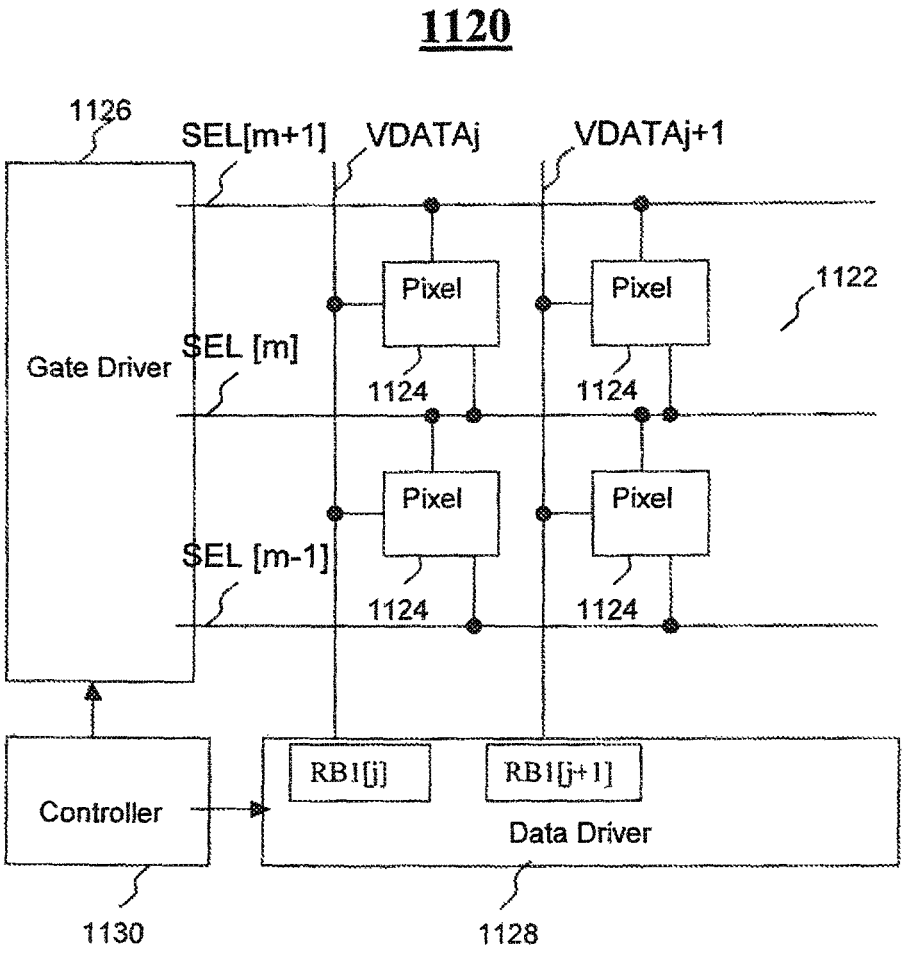
FIG. 26 is a diagram illustrating an example of a display system having a read back circuit of FIG. 25.

FIG. 26 illustrates an example of a display system having the read back circuit 360 of FIG. 25. The display system 1120 of FIG. 26 includes a display array 1122 having a plurality of pixels 1124. The pixel 1124 includes the drive circuit 304 of FIGS. 20 and 21, and may be the pixel circuit 300 of FIG. 20 or the pixel circuit 330 of FIG. 21. The pixel 1124 may be same or similar to the pixel 1084 of FIG. 23 or 1106 of FIG. 24.

In FIG. 26, four pixels 1124 are shown. However, the number of the pixels 1124 may vary in dependence upon the system design, and does not limited to four. In FIG. 26, three address lines and two data lines are shown. However, the number of the select lines and the data lines may vary in dependence upon the system design.

For each column, a read back circuit RB1[*n*] (n=j, j+1) and a switch SW1[*n*] (not shown) are provided. The read back circuit RB 1 [*n*] may include the SW1 [*n*], The read back circuit RB1[*n*] and the switch SW1[*n*] correspond to the read back 360 and the switch SW1 of FIG. 25, respectively. In the description below, the terms RB1 and RB 1 [*n*] may be used interchangeably, and RB1 may refer to the read back circuit 360 of FIG. 25 for a certain row.

The display array 1122 is an active matrix light emitting display. In one example, the display array 1122 is an AMOLED display array. The display array 1122 may be a single color, multi-color or a fully color display, and may include one or more than one electroluminescence (EL) element (e.g., organic EL). The display array 1122 may be used in mobiles, personal digital assistants (PDAs), computer displays, or cellular phones.

A gate driver 1126 includes an address driver for driving the address lines. The gate driver 1126 may be same or similar to the gate driver 1086 of FIG. 23 or the gate driver 1108 of FIG. 24. A data driver 1128 generates a programming data and drives the data lines. The data driver 1128 includes a circuit for calculating the programming data based on the output of the corresponding read back circuit RB1 [*n*]. A controller 1130 controls the drivers 1126 and 1128 to drive the pixels 1124 as described above. The controller 1130 controls the switch SW1[*n*] to turn on or off so that the RB1[*n*] is connected to the corresponding data line VDATAn.

The pixels 1124 are operated to provide aging knowledge for the of-panel algorithm in which the programming voltage is calibrated at the controller 1130 or driver side 1128 according to the output voltage of the read back circuit RBI. A simple calibration can be scaling in which the programming voltage is scaled up by the change in the output voltage of the read back circuit RB1.

In FIG. 26, each of the pixels 1124 includes the sensor 316 of FIGS. 20 and 21. In another example, the display array 1120 may include one or more than one reference pixel having the sensor 316, as shown in FIG. 27.

Figure 27:
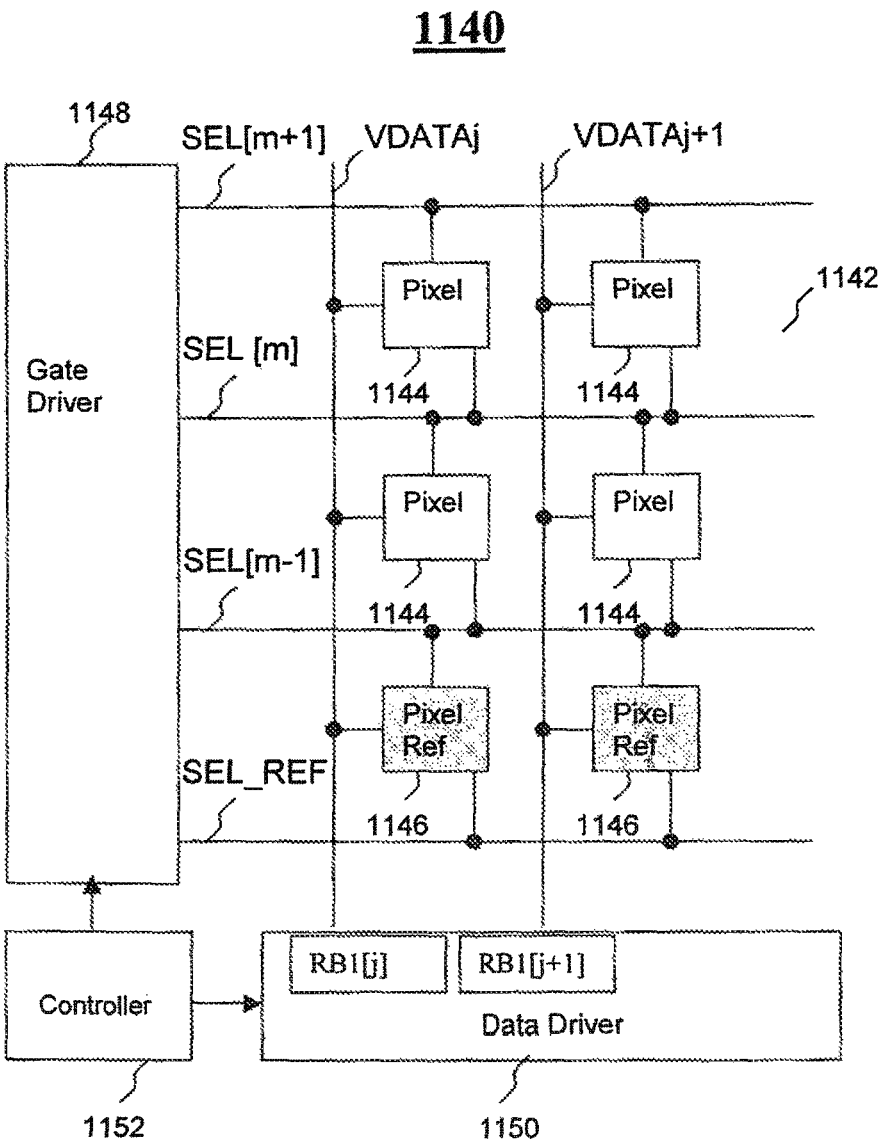
FIG. 27 is a diagram illustrating another example of a display system having the read back circuit of FIG. 25.

FIG. 27 illustrates another example of a display system having the read back circuit of FIG. 25. The display system 1140 of FIG. 27 includes a display array 1142 having a plurality of pixels 1144 and one or more than one reference pixels 1146. The reference pixel 1146 includes the drive circuit 304 of FIGS. 20 and 21, and may be the pixel circuit 300 of FIG. 20 or the pixel circuit 330 of FIG. 21. In FIG. 27, two reference pixels 1146 are shown. However, the number of the pixels 1084 may vary in dependence upon the system design, and does not limited to two. The pixel 1144 includes an OLED and a drive transistor for driving the OLED, and does not include the sensor 316 of FIGS. 20 and 21. SEL_REF is a select line for selecting the discharging transistors in the array of the reference pixels 1146.

A gate driver 1148 drives the address lines and the select line SEL_REF. The gate driver 1148 may be same or similar to the gate driver 1126 of FIG. 26. A data driver 1150 generates a programming data, calibrates the programming data and drives the data lines. The data driver 1150 may be same or similar to the data driver 1128 of FIG. 26. A controller 1152 controls the drivers 1148 and 1150.

The reference pixels 1146 are operated to provide aging knowledge for the of-panel algorithm in which the programming voltage is calibrated at the controller 1152 or driver side 1150 according to the output voltage of the read back circuit RB1. A simple calibration can be scaling in which the programming voltage is scaled up by the change in the output voltage of the read back circuit RB1.

Figure 28:
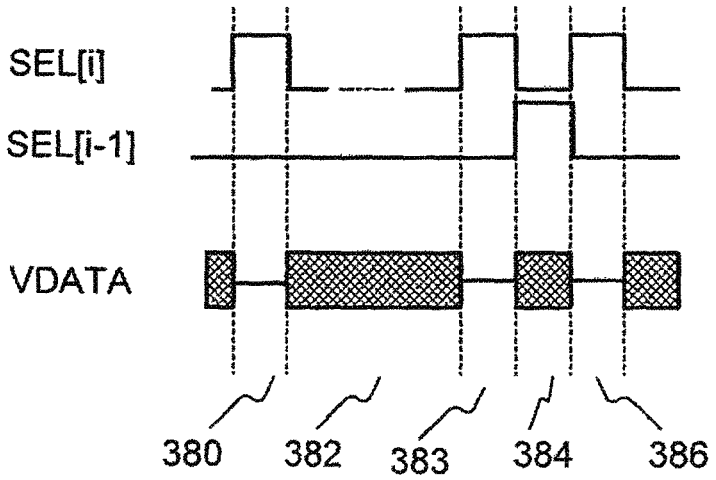
FIG. 28 is a timing diagram illustrating an example of a method of driving a pixel circuit in accordance with a further embodiment of the present invention.

FIG. 28 illustrates an example of a method of driving a pixel circuit in accordance with a further embodiment of the present invention. The display system 1120 of FIG. 26 and the display system 1140 of FIG. 27 are capable of operating according to the waveforms of FIG. 28. By applying the waveforms of FIG. 28 to the display system having the read back circuit (e.g., 360 of FIG. 3, RB1 of FIGS. 26 and 27), the of-panel calibration is implemented.

The operation cycles of FIG. 28 include operation cycles 380, 382, 383, 384, and 386. The operation cycle 380 is a programming cycle for the ith row. The operation cycle 382 is a driving cycle for the ith row. The driving cycle of each row is independent of the other rows, The operation cycle-383 is an initialization cycle for the ith row. The operation cycle 384 is an integration cycle for the ith row, The operation cycle 386 is a read back cycle for the ith row.

Referring to FIGS. 25 to 28, during the programming cycle 380 for the ith row, node A4 of the pixel circuit in the ith row is charged to a programming voltage through the switch transistor 308 while the select line SEL[i] is high. During the programming cycle 380 for the ith row, node A4 is charged to a calibrated programming voltage. During the driving cycle 382 for the ith row, the OLED luminance is controlled by the driver transistor 306: During the initialization cycle 383 for the ith row, node A4 is charged to a bias voltage. During the integration cycle 384 for the ith row, the SEL[i−1] is high and so the voltage at node A4 is discharged through the sensor 316. During the read back cycle 386, the change in the voltage at node A4 is read back to be used for calibration (e.g. scaling the programming voltage).

At the beginning of the read back cycle 384, the switch SW1 of the read back circuit RB1 is on, and the data line VDATA is charged to Vb2. Also the capacitor 364 is charged to a voltage, Vpre, as a result of leakage contributed from all the pixels connected to the date line VDATA. Then the select line SEL[i] goes high and so the discharged voltage Vdisch is developed across the capacitor 364. The difference between the two extracted voltages (Vpre and Vdisch) are used to calculate the pixel aging.

The sensor 316 can be OFF most of the time and be ON just for the integration cycle 384. Thus, the sensor 316 ages very slightly. In addition, the sensor 316 can be biased correctly to suppress its degradation significantly.

Figure 29:
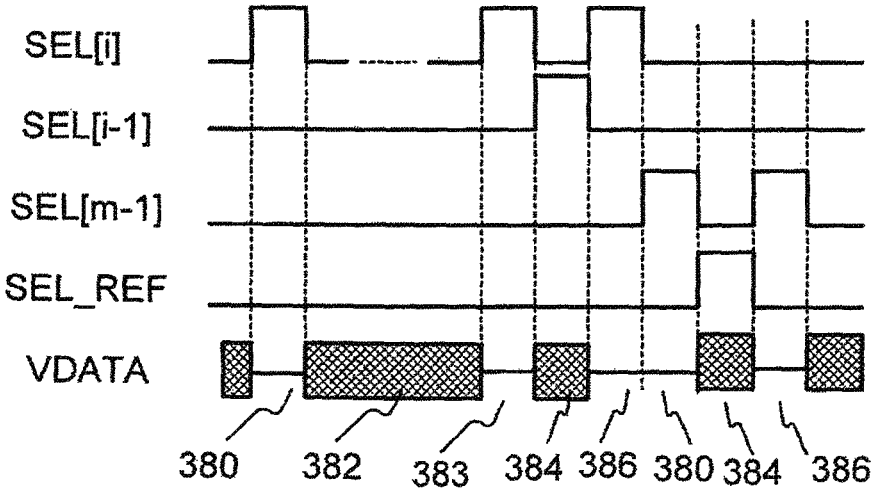
FIG. 29 is a diagram illustrating an example of a method of extracting the aging of a sensor of FIG. 25.

In addition, this method can be used for extracting the aging of the sensor 316. FIG. 29 illustrates an example of a method of extracting the aging of the sensor 316. The extracted voltages of the sensors for a dark pixel and a dark reference pixel can be used to find out the aging of the sensor 316. For example, the display system 1140 of FIG. 27 is capable of operating according to the waveforms of FIG. 29.

The operation cycles of FIG. 29 include operation cycles 380, 382, 383, 384, and 386. The operation cycle 380 is a programming cycle for the ith row. The operation cycle 382 is a driving cycle for the ith row. The operation cycle 383 is an initialization cycle for the ith row. The operation cycle 384 is an integration cycle for the ith row. The operation cycle 386 is a read back cycle for the ith row. The operation cycle 380 (the second occurrence) is an initialization for a reference row. The operation cycle 384 (the second occurrence) is an integration cycle for the reference row. The operation cycle 386 (the second occurrence) is a read back cycle (extraction) for the reference row.

The reference row includes one or more reference pixels (e.g., 1146 of FIG. 27), and is located in the (m−1)th row. SEL_REF is a select line for selecting the discharging transistors (e.g., 310 of FIG. 25) in the reference pixels in the reference row.

Referring to FIGS. 25, 27 and 29, to extract the aging of the sensor 316, a normal pixel circuit (e.g., 1144) is OFF. The difference between the extracted voltage via the output 316 from the normal pixel and voltage extracted for the OFF state of the reference pixel (e.g., 1146) is extracted. The voltage for the OFF state of the reference pixel is extracted where the reference pixel is not under stress. This difference results in the extraction of the degradation of the sensor 316.

Figure 30:
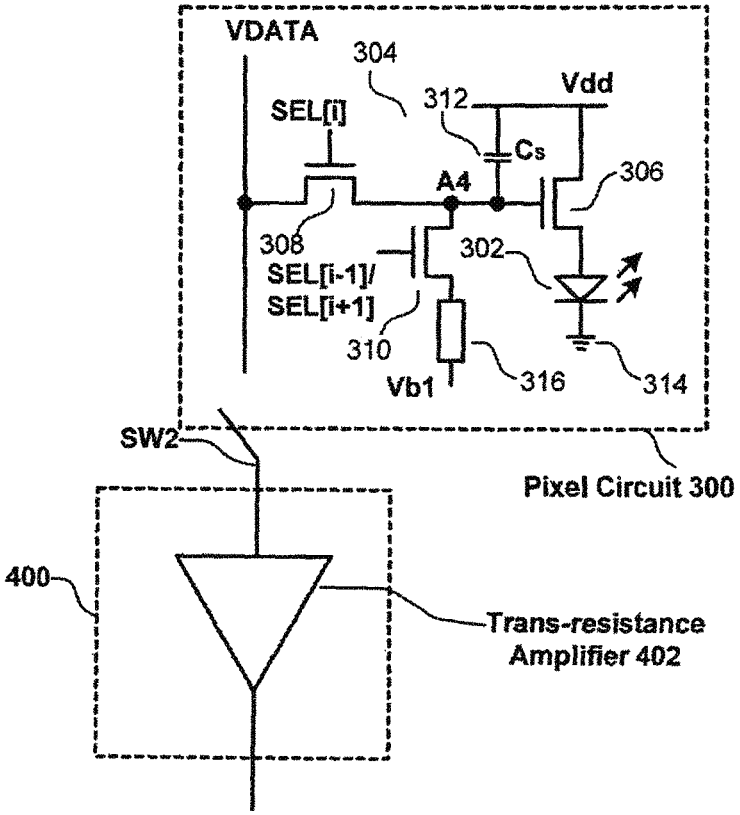
FIG. 30 is a diagram illustrating an example of a pixel system in accordance with another embodiment of the present invention.

FIG. 30 illustrates an example of a pixel system in accordance with another embodiment of the present invention. The pixel system of FIG. 30 includes a read back circuit 400. The read-back circuit 400 includes a trans-resistance amplifier 402. One terminal of the trans-resistance amplifier 402 is connectable to the data line VDATA via a switch SW2. The trans-resistance amplifier 402 reads back the voltage discharged from the node A4 via the switch SW2. The switch SW2 may be same or similar to the switch SW1 of FIG. 25.

The output of the trans-resistance amplifier 402 varies in dependent upon the voltage at node A4. The time depending characteristics of the pixel circuit is readable from node A4 via the trans-resistance amplifier 402.

In FIG. 30, one read back circuit 400 and one switch SW2 are illustrated for one pixel circuit. However, the read back circuit 400 and the switch SW2 may be provided for a group of pixel circuits (e.g., pixel circuits in a column). In FIG. 30, the read back circuit 400 and the switch SW2 are provided to the pixel circuit 300. In another example, the read back circuit 400 and the switch SW2 are applied to the pixel circuit 330 of FIG. 21.

Figure 31:
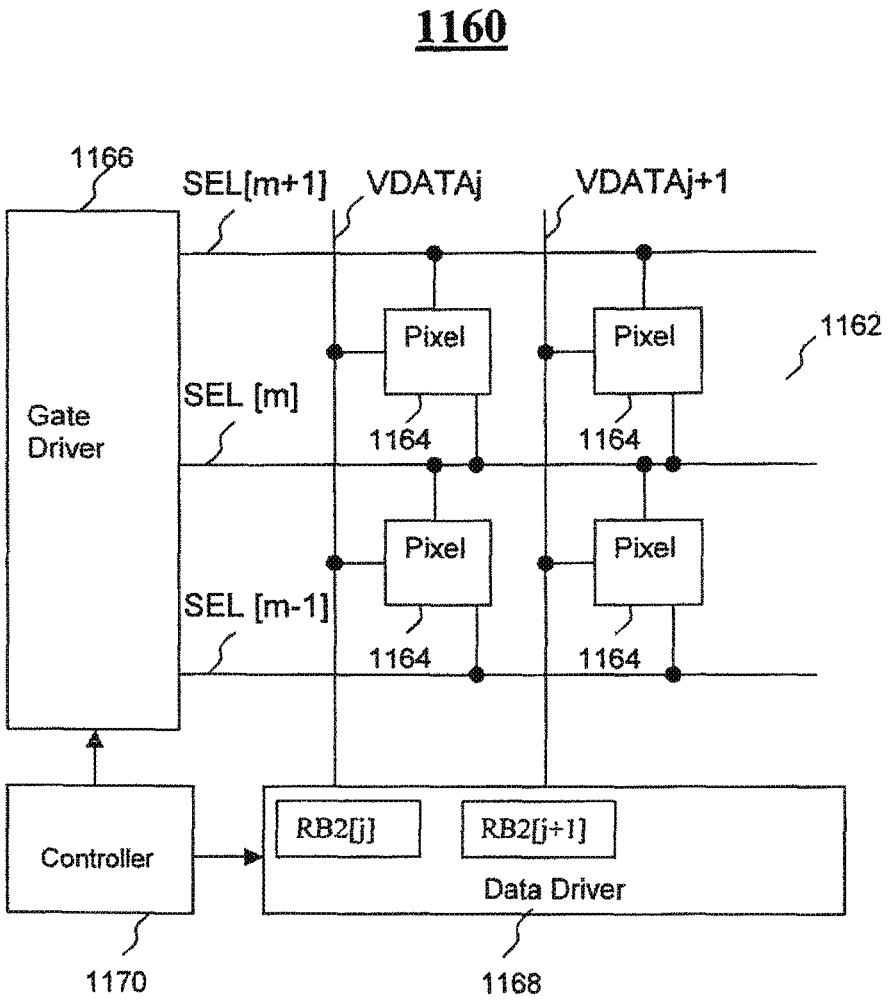
FIG. 31 is a diagram illustrating an example of a display system having a read back circuit of FIG. 30.

FIG. 31 illustrates an example of a display system having the read back circuit 400 of FIG. 30. The display system 1160 of FIG. 31 includes a display array 1162 having a plurality of pixels 1164. The pixel 1164 includes the drive circuit 304 of FIGS. 20 and 21, and may be the pixel circuit 300 of FIG. 20 or the pixel circuit 330 of FIG. 21. The pixel 1164 may be same or similar to the pixel 1124 of FIG. 26 or 1146 of FIG. 27.

In FIG. 31, four pixels 1164 are shown. However, the number of the pixels 1164 may vary in dependence upon the system design, and does not limited to four. In FIG. 31, three address lines and two data lines are shown. However, the number of the select lines and the data lines may vary in dependence upon the system design.

For each column, a read back circuit RB2[*n*] (n j, j+1) and a switch SW2[*n*] (not shown) are provided. The read back circuit RB2[*n*] may include the SW2[*n*]. The read back circuit RB2[*n*] and the switch SW2[*n*] correspond to the read back 400 and the switch SW2 of FIG. 30, respectively. In the description below, the terms RB2 and RB2[*n*] may be used interchangeably, and RB2 may refer to the read back circuit 400 of FIG. 30 for a certain row.

The display array 1162 is an active matrix light emitting display. In one example, the display array 1162 is an AMOLED display array. The display array 1162 may be a single color, multi-color or a fully color display, and may include one or more than one electroluminescence (EL) element (e.g., organic EL). The display array 1162 may be used in mobiles, personal digital assistants (PDAs), computer displays, or cellular phones.

A gate driver 1166 includes an address driver for driving the address lines. The gate driver 1166 may be same or similar to the gate driver 1126 of FIG. 26 or the gate driver 1148 of FIG. 27. A data driver 1168 generates a programming data and drives the data lines. The data driver 1168 includes a circuit for calculating the programming data based on the output of the corresponding read back circuit RB2[*n*]. A controller 1170 controls the drivers 1166 and 1168 to drive the pixels 1164 as described above. The controller 1170 controls the switch SW2[*n*] to turn on or off so that the RB2[*n*] is connected to the corresponding data line VDATAn.

The pixels 1164 are operated to provide aging knowledge for the of-panel algorithm in which the programming voltage is calibrated at the controller 1170 or driver side 1168 according to the output voltage of the read back circuit RB2. A simple calibration can be scaling in which the programming voltage is scaled up by the change in the output voltage of the read back circuit RB2.

In FIG. 31, each of the pixels 1164 includes the sensor 316 of FIGS. 20 and 21. In another example, the display array 1160 may include one or more than one reference pixel having the sensor 316, as shown in FIG. 32.

Figure 32:
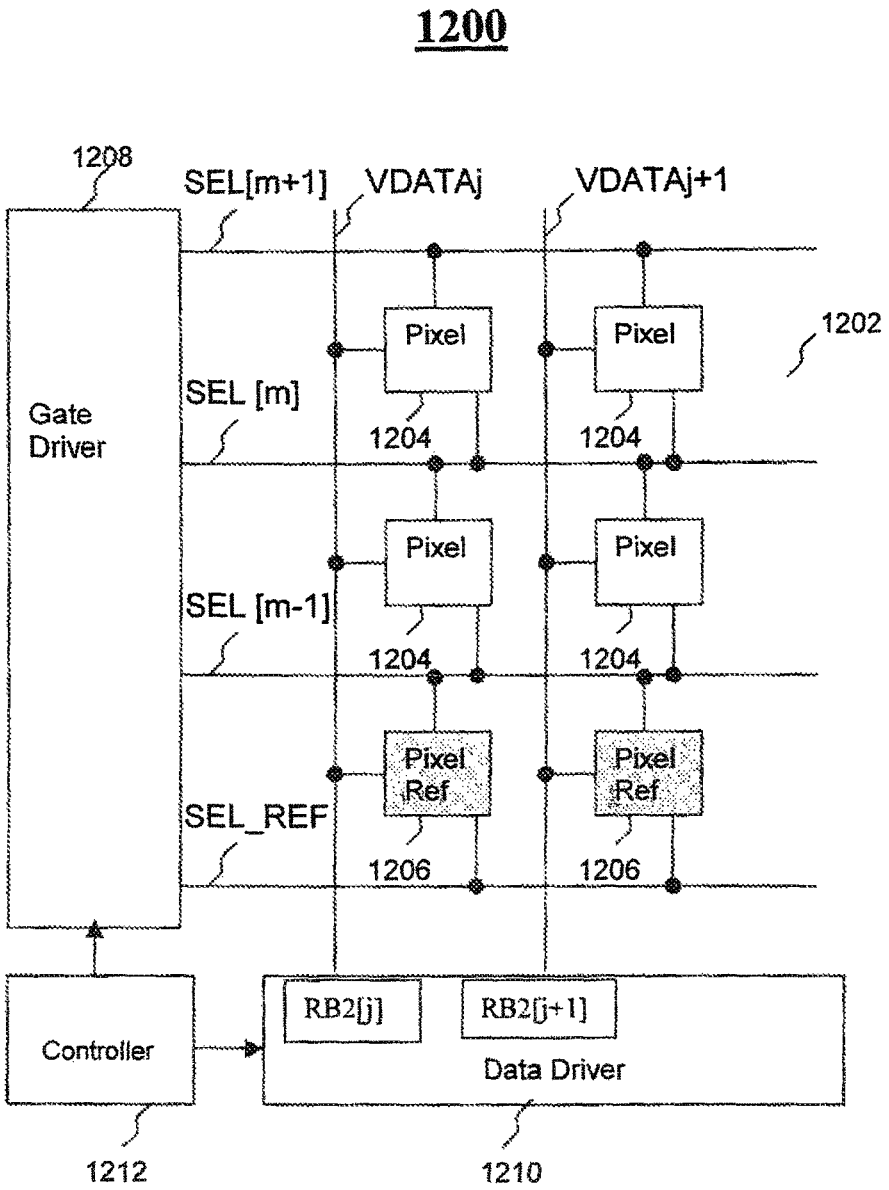
FIG. 32 is a diagram illustrating another example of a display system having the read back circuit of FIG. 30.

FIG. 32 illustrates another example of a display system having the read back circuit 400 of FIG. 30. The display system 1200 of FIG. 32 includes a display array 1202 having a plurality of pixels 1204 and one or more than one reference pixels 1206. The reference pixel 1206 includes the drive circuit 304 of FIGS. 20 and 21, and may be the pixel circuit 300 of FIG. 20 or the pixel circuit 330 of FIG. 21. In FIG. 32, two reference pixels 1206 are shown. However, the number of the pixels 1204. may vary in dependence upon the system design, and does not limited to two. The pixel 1204 includes an OLED and a drive transistor for driving the OLED, and does not include the sensor 316 of FIGS. 20 and 21. SEL REF is a select line for selecting the discharging transistors in the array of the reference pixels 1206.

A gate driver 1208 drives the address lines and the select line SEL REF. The gate driver 1208 may be same or similar to the gate driver 1148 of FIG. 27 or the gate driver 1166 of FIG. 31. A data driver 1210 generates a programming data, calibrates the programming data and drives the data lines. The data driver 1210 may be same or similar to the data driver 1150 of FIG. 27 or the data driver 1168 of FIG. 32. A controller 1212 controls the drivers 1208 and 1210.

The reference pixels 1206 are operated to provide aging knowledge for the of-panel algorithm in which the programming voltage is calibrated at the controller 1212 or driver side 1210 according to the output voltage of the read back circuit RB2. A simple calibration can be scaling in which the programming voltage is scaled up by the change in the output voltage of the read back circuit RB2.

Figure 33:
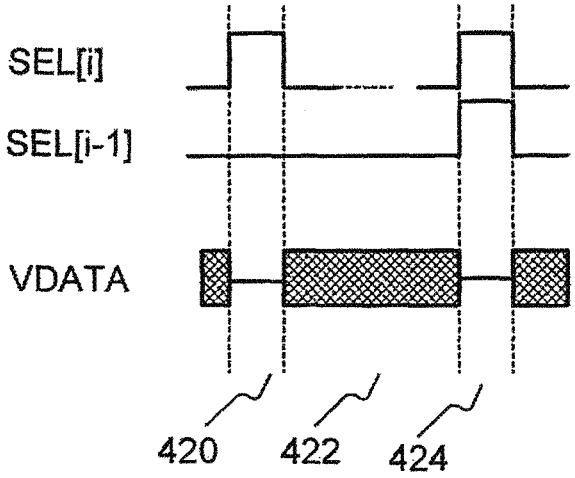
FIG. 33 is a timing diagram illustrating an example of a method of driving a pixel circuit in accordance with a further embodiment of the present invention.

FIG. 33 illustrates an example of a method of driving a pixel circuit in accordance with a further embodiment of the present invention. The display system 1160 of FIG. 31 and the display system 1200 of FIG. 32 are capable of operating according to the waveforms of FIG. 33. By applying the waveforms of FIG. 33 to the display system having the read back circuit (e.g., 400 of FIG. 30, RB2 of FIGS. 31 and 32), the of-panel calibration is implemented.

The operation cycles of FIG. 33 include operation cycles 410, 422 and 422 for a row. The operation cycle 420 is a programming cycle for the ith row. The operation cycle 422 is a driving cycle for the ith row. The operation cycle 424 is a read back (extraction) cycle for the ith row.

Referring to FIGS. 30 to 33, during the programming cycle 420 for the ith row, node A4 of the pixel circuit in the ith row is charged to a programming voltage through the switch transistor 308 while the select line SEL[i] is high. During the driving cycle 422 for the ith row, the pixel luminance is controlled by the current of the drive transistor 306. During the extraction cycle 424 for the ith row, SEL [i] and SEL[i−1] are high and the current of the sensor 316 is monitored. The change in this current is amplified by the read back circuit RB2. This change is used to measure the luminance degradation in the pixel and compensate for it by calibrating the programming voltage (e.g, scaling the programming voltage).

At the beginning of the read-back cycle 424, the switch SW2 for the row that the algorithm chooses for calibration is ON while SEL[i] is low. Therefore, the leakage current is extracted as the output voltage of the trans-resistance amplifier 402. The selection of the row can be based on stress history, random, or sequential technique. Next, SEL[i] goes high and so the sensor current related to the luminance or temperature of the pixel is read back as the output voltage of the trans-resistance amplifier 402. Using the two extracted voltages for leakage current and sensor current, one can calculated the pixel aging.

The sensor 316 can be OFF most of the time and be ON just for the operation cycle 424. Thus, the sensor 316 ages very slightly. In addition, the sensor 316 can be biased correctly to suppress its degradation significantly.

Figure 34:
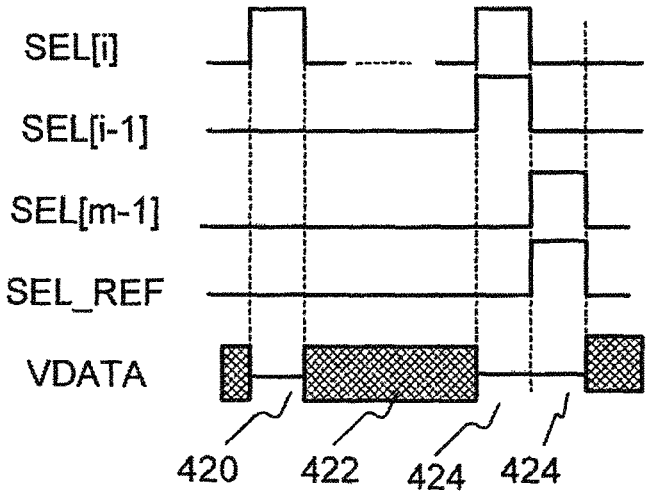
FIG. 34 is a timing diagram illustrating another example of a method of extracting the aging of a sensor of FIG. 30.

In addition, this method can be used for extracting the aging of the sensor 316. FIG. 34 illustrates an example of a method of extracting the aging of the sensor 316 of FIG. 30. For example, the display system 1200 of FIG. 32 operates according to the waveforms of FIG. 34.

The operation cycles of FIG. 34 include operation cycles 420, 422 and 424. The operation cycle 420 (the first occurrence) is a programming cycle for the ith row. The operation cycle 422 is a driving cycle for the ith row. The operation cycle 424 (the first occurrence) is a read back (extraction) cycle for the ith row. The operation cycle 424 (the second occurrence) is a read back (extraction) cycle for a reference row.

The reference row includes one or more reference pixels (e.g., 1206 of FIG. 32) and is located in the (m−1)th row. SEL REF is a select line for selecting the discharging transistors (e.g., 310 of FIG. 30) in the reference pixels in the reference row.

Referring to FIGS. 30, 32 and 34, to extract the aging of the sensor 316, a normal pixel circuit (e.g., 1204) is OFF. The difference between the extracted voltage via the output of the trans-resistance amplifier 402 from the normal pixel circuit and voltage extracted for the OFF state of the reference pixel (e.g., 1206) is extracted. The voltage for the OFF state of the reference pixel is extracted where the reference pixel is not under stress. This results in the extraction of the degradation of the sensor 316.

Figure 35:
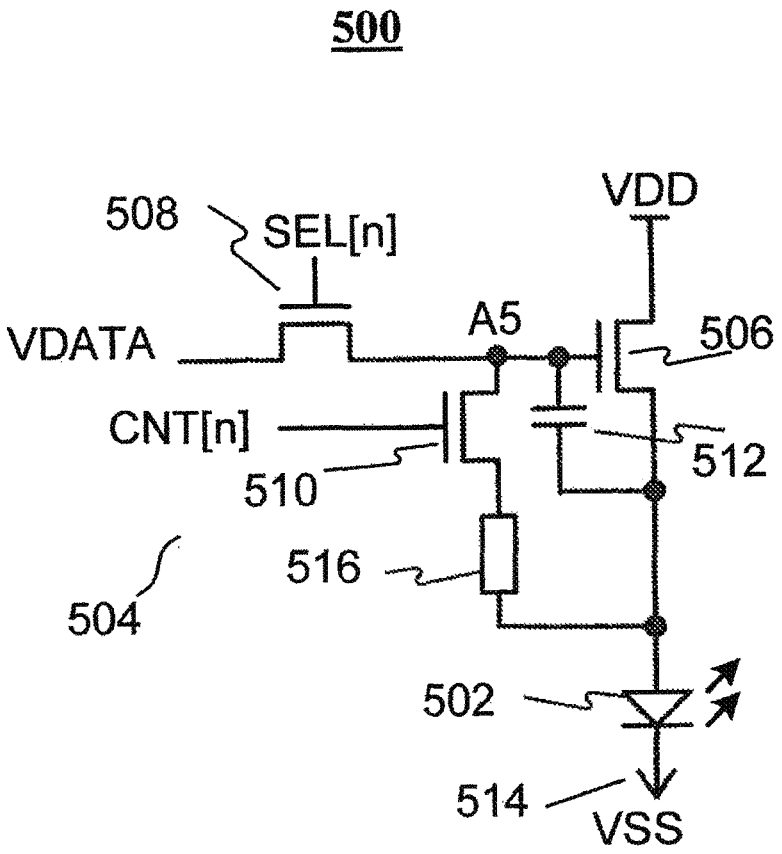
FIG. 35 is a diagram illustrating an example of a pixel circuit to which a pixel drive scheme in accordance with a further embodiment of the present invention is applied.

FIG. 35 illustrates an example of a pixel circuit to which a pixel drive scheme in accordance with a further embodiment of the present invention. The pixel circuit 500 of FIG. 35 includes an OLED 502 and a drive circuit 504 for driving the OLED 502. The drive circuit 504 includes a drive transistor 506, a switch transistor 508, a discharging transistor 510, an adjusting circuit 510, and a storage capacitor 512.

The OLED 502 may be same or similar to the OLED 212 of FIG. 13 or the OLED 302 of FIG. 20. The capacitor 512 may be same or similar to the capacitor 224 of FIG. 13 or the capacitor 312 of FIG. 20. The transistors 506, 508 and 510 may be same or similar to the transistors 206, 220, and 222 of FIG. 13 or the transistors 306, 308 and 310 of FIG. 20. In one example, each of the transistors 506, 508 and 510 includes a gate terminal, a source terminal and a drain terminal.

The drive transistor 506 is provided between a voltage supply line VDD and the OLED 502. One terminal (e.g., drain) of the drive transistor 506 is connected to VDD. The other terminal (e.g., source) of the drive transistor 506 is connected to one electrode (e.g., anode electrode) of the OLED 502. The other electrode (e.g., cathode electrode) of the OLED 502 is connected to a power supply line VSS (e.g., common ground) 514. One terminal of the storage capacitor 512 is connected to the gate terminal of the drive transistor 506 at node A5. The other terminal of the storage capacitor 512 is connected to the OLED 502. The gate terminal of the switch transistor 508 is connected to a select line SEL [n]. One terminal of the switch transistor 508 is connected to data line VDATA. The other terminal of the switch transistor 508 is connected to node A5. The gate terminal of the transistor 510 is connected to a control line CNT[n]. In one example, n represents the nth row in a display array. One terminal of the transistor 510 is connected to node A.S. The other terminal of the transistor 510 is connected to one terminal of the adjusting circuit 516. The other terminal of the adjusting circuit 516 is connected to the OLED 502.

The adjusting circuit 516 is provided to adjust the voltage of A5 with the discharging transistor 510 since its resistance changes based on the pixel aging. In one example, the adjusting circuit 516 is the transistor 218 of FIG. 13. In another example, the adjusting circuit 516 is the sensor 316 of FIG. 20.

To improve the shift in the threshold voltage of the drive transistor 506, the pixel circuit is turned off for a portion of frame time.

Figure 36:
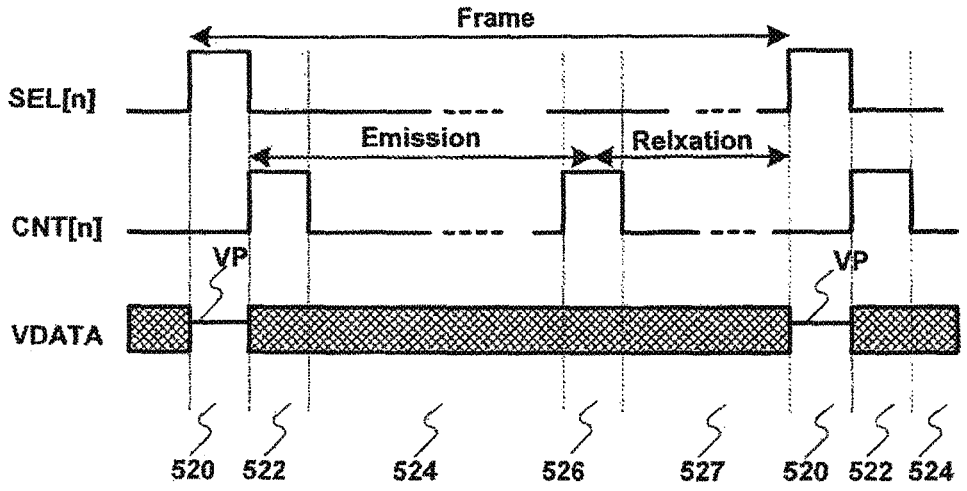
FIG. 36 is a timing diagram for an example of a method of driving a pixel circuit in accordance with a further embodiment of the present invention.

FIG. 36 illustrates an example of a method of driving a pixel circuit in accordance with a further embodiment of the invention. The waveforms of FIG. 36 are applied to the pixel circuit of FIG. 35. The operation cycles for the pixel circuit 500 include a programming cycle 520, a discharge cycle 522, an emission cycle 524, a reset cycle 526, and a relaxation cycle 527.

During the programming cycle 520, node A5 is charged to a programming voltage VP. During the discharge cycle 522, CNT[n] goes high, and the voltage at node A5 is discharge partially to compensate for the aging of the pixel. During the emission cycle 524, SEL[n] and CNT[n] go low. The OLED 502 is controlled by the drive transistor 506 during the emission cycle 524. During the reset cycle 526, the CNT[n] goes to a high voltage so as to discharge the voltage at node A5 completely during the reset cycle 526. During the relaxation cycle 527, the drive transistor 506 is not under stress and recovers from the emission 524. Therefore, the aging of the drive transistor 506 is reduced significantly.

Figure 37:
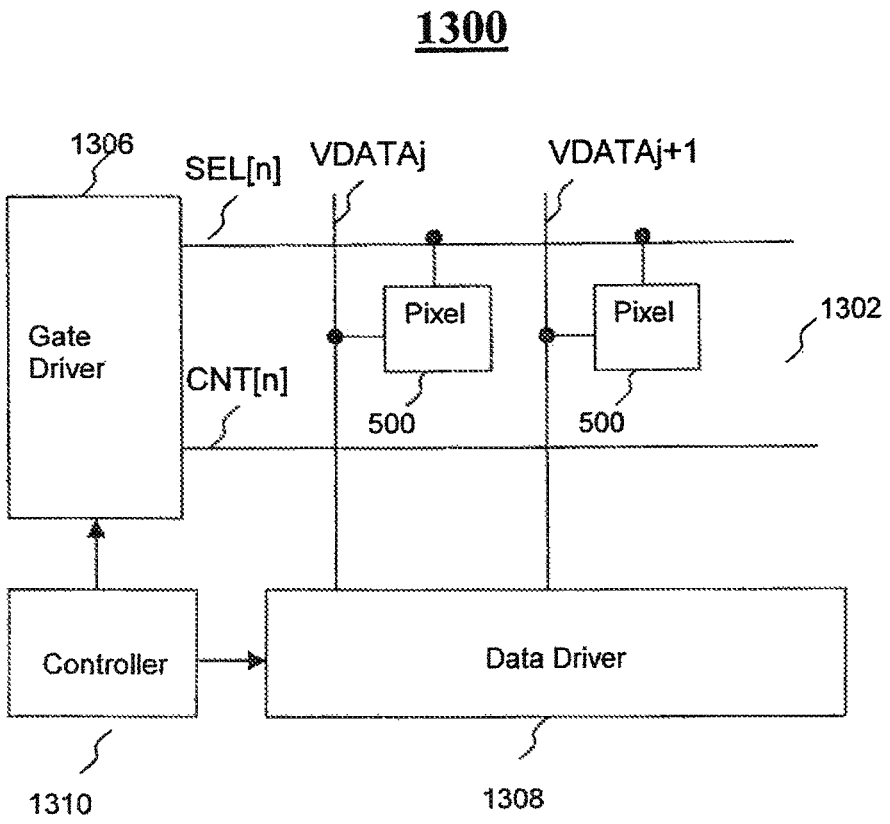
FIG. 37 is a diagram illustrating an example of a display system having the pixel circuit of FIG. 35.

FIG. 37 illustrates an example of a display system including the pixel circuit of FIG. 35. The display system 1300 of FIG. 37 includes a display array 1302 having a plurality of pixels 500. The display array 1302 is an active matrix light emitting display. In one example, the display array 1302 is an AMOLED display array. The pixels 500 are arranged in rows and columns. In FIG. 37, two pixels 500 for the nth row are shown. The display array 1302 may include more than two pixels.

The display array 1302 may be a single color, multi-color or a fully color display, and may include one or more than one electroluminescence (EL) element (e g, organic EL). The display array 1302 may be used in mobiles, personal digital assistants (PDAs), computer displays, or cellular phones.

Address line SEL[n] is proved to the nth row. Control line CNT[n] is proved to the nth row. Data line VDATAk (k=j, j+1) is proved to the kth column. The address line SEL[n] corresponds to SEL[n] of FIG. 35. The control line CNT[n] corresponds to CNT[n] of FIG. 35. The data Line VDATAk (k=j, j+1) corresponds to VDATA of FIG. 35.

A gate driver 1306 drives SEL[n]. A data driver 1308 generates a programming data and drives VDATAk. A controller 1310 controls the drivers 1306 and 1308 to drive the pixels 500 to produce the waveforms of FIG. 36.

Figure 38:
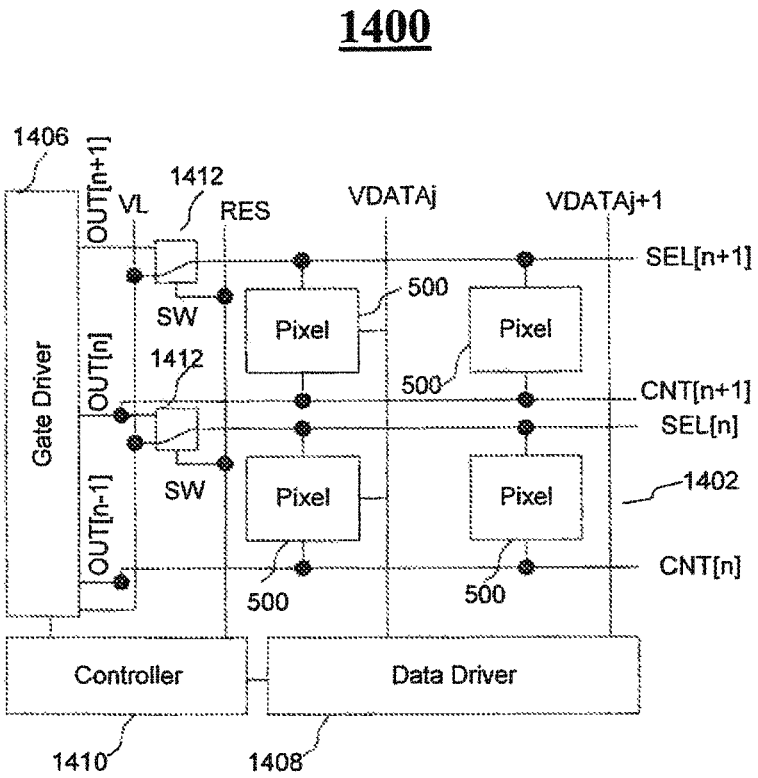
FIG. 38 is a diagram illustrating another example of a display system having the pixel circuit of FIG. 35.

FIG. 38 illustrates another example of a display system including the pixel circuit 500 of FIG. 35. The display system 1400 of FIG. 38 includes a display array 1402 having a plurality of pixels 500. The display array 1402 is an active matrix light emitting display. In one example, the display array 1302 is an AMOLED display array. The pixels 500 are arranged in rows and columns. In FIG. 38, four pixels 500 for the nth row are shown. The display array 1402 may include more than four pixels.

SEL[i] (i=n, n+1) is a select line and corresponds to SEL[n] of FIG. 35. CNT[i] (i=n, n+1) is a control line and corresponds to CNT[n] of FIG. 35, OUT[k] (k=n−1, n, n+1) is an output from a gate driver 1406. The select line is connectable to one of the outputs from the gate driver 1402 or VL line, VDATAm (m=j+1) is a data line and corresponds to VDATA of FIG. 35. VDATAm is controlled by a data driver 1408. A controller 1410 controls the gate driver 1406 and the data driver 1408 to operate the pixel circuit 500.

The control lines and select lines share the same output from the gate driver 1406 through switches 1412. During the discharge cycle 526 of FIG. 36, RES signal changes the switches 1412 direction and connect the select lines to the VL line which has a low voltage to turn off the transistor 508 of the pixel circuit 500. OUT[n−1] is high and so CNT[n] is high. Thus the voltage at node A5 is adjusted by the adjusting circuit 516 and discharging transistor 510. During other operation cycles, RES signal and switches 1412 connect the select lines to the corresponding output of the gate driver (e.g., SEL[n] to OUT[n]). The switches 1412 can be fabricated on the panel using the panel fabrication technology (e.g. amorphous silicon) or it can be integrated inside the gate driver.

Figure 39:
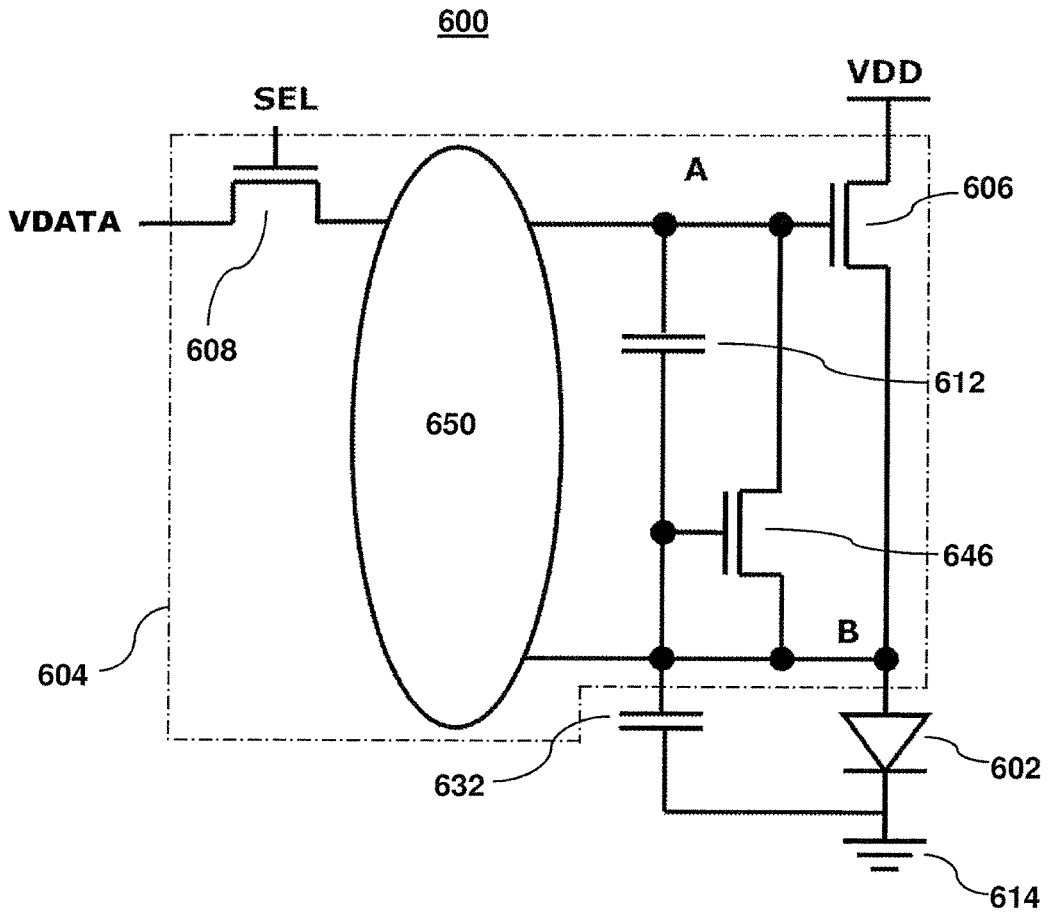
FIG. 39 is a diagram illustrating an example of a pixel circuit to which a pixel drive scheme in accordance with another embodiment of the present invention is applied.

FIG. 39 illustrates an example of a pixel circuit to which a pixel drive scheme in accordance with a further embodiment of the present invention is applied. The pixel circuit 600 is programmed according to programming information during a programming cycle, and driven to emit light according to the programming information during an emission cycle. The pixel circuit 600 of FIG. 39 includes an OLED 602 and a drive circuit 604 for driving the OLED 602. OLED 602 is a light emitting device for emitting light during an emission cycle. OLED 602 has capacitance 632. The OLED 602 includes, for example, an anode electrode, a cathode electrode and an emission layer between the anode electrode and the cathode electrode.

The drive circuit 604 includes a drive transistor 606, a switch transistor 608, a switch block 650, a storage capacitor 612 and a regulating transistor 646. The drive transistor 606 conveys a drive current through OLED 602 during the emission cycle. The storage capacitor 612 is charged with a voltage based at least in part on the programming information during the programming cycle. The switch transistor 608 is operated according to a select line SEL, and conveys the voltage to the storage capacitor 612 during the programming cycle. The regulating transistor 646 conveys a leakage current to a gate terminal of the drive transistor 606, thereby adjusting a gate voltage of the drive transistor 606.

In one example, the transistors 606, 608 and 646 are n-type transistors. In another example, the transistors 606, 608 and 646 are p-type transistors or a combination of n-type and p-type transistors. In one example, each of the transistors 606, 608 and 646 includes a gate terminal, a source terminal and a drain terminal.

The transistors 606, 608 and 646 may be fabricated using amorphous silicon, nano/micro crystalline silicon, poly silicon, organic semiconductors technologies (e.g., organic TFT), NMOS/PMOS technology or CMOS technology (e.g., MOSFET).

The drive transistor 606 is provided between a voltage supply line VDD and the OLED 602 directly or through a switch. One terminal of the drive transistor 606 is connected to VDD. The other terminal of the drive transistor 606 is connected to one electrode (e.g., anode electrode) of the OLED 602. The gate terminal of the switch transistor 608 is connected to a select line SEL. One terminal of the switch transistor 608 is connected to a data line VDATA. The other terminal of the switch transistor 608 is connected to node A. One terminal of the storage capacitor 612 is connected to node A. The other terminal of the storage capacitor 612 is connected to the OLED 602. The other electrode (e.g., cathode electrode) of the OLED 602 is connected to a power supply line (e.g., common ground) 614.

One terminal of the regulating transistor 646 is connected to the gate terminal of the drive transistor 606. The second terminal of the regulating transistor 646 is connected to one electrode (e.g., anode electrode) of the OLED 602. The gate terminal of the regulating transistor 646 is connected to the second terminal of the regulating transistor 646. Thus, regulating transistor 646 is biased in sub-threshold regime, providing very small current. At higher temperatures, the sub-threshold current of the regulating transistor 646 increases significantly, reducing the average gate voltage of the drive transistor 606.

Switch block 650 can comprise any of the configurations of discharging transistors, additional switch transistors, resistors, sensors and/or amplifiers that are described above with respect to the various embodiments of the invention. For example, as shown in FIG. 1, switch block 650 can comprise a discharging transistor 108. Discharging transistor 108 discharges the voltage charged on the storage capacitor 612 during the emission cycle. In this embodiment, one terminal of the discharging transistor 108 and its gate terminal are connected to the gate terminal of drive transistor 606 at node A. The other terminal of the discharging transistor 108 is connected to the OLED 602.

In another example, as shown in FIG. 8, switch block 650 can comprise a second switch transistor 172 and a discharging transistor 168 connected in series between the gate terminal of the drive transistor 606 and one electrode (e.g., anode electrode) of the OLED 602. The gate terminal of the switch transistor 172 is connected to a bias voltage line VB. The gate terminal of the discharging transistor 168 is connected to the gate terminal of the drive transistor 606 at node A. Discharging transistor 168 discharges the voltage charged on the storage capacitor 612 during the emission cycle.

In still another example, as shown in FIG. 13, switch block 650 can comprise a second switch transistor 222 and a discharging transistor 218 connected in series between the gate terminal of drive transistor 606 and one electrode (e.g., anode electrode) of the OLED 602. The gate terminal of the switch transistor 222 is connected to a select line SEL[n+1]. The gate terminal of the discharging transistor 218 is connected to the gate terminal of the drive transistor 606 at node A. Discharging transistor 218 discharges the voltage charged on the storage capacitor 612 during the emission cycle.

In another example, as shown in FIG. 35, switch block 650 can comprise a discharging transistor 510 connected in series between the gate terminal of drive transistor 606 and one electrode (e.g., anode electrode) of the OLED 602. The gate terminal of the discharging transistor is connected to a control line CNT[n]. The adjusting circuit 516 is provided to adjust the voltage of node A with the discharging transistor 510 since its resistance changes based on the pixel aging. In one example, the adjusting circuit 516 is the transistor 218 of FIG. 13. In another example, the adjusting circuit 516 is the sensor 316 of FIG. 20. Discharging transistor 510 discharges the voltage charged on the storage capacitor 612 during the emission cycle.

According to these embodiments, the pixel circuit 600 provides constant averaged current over the frame time.

Figure 40:
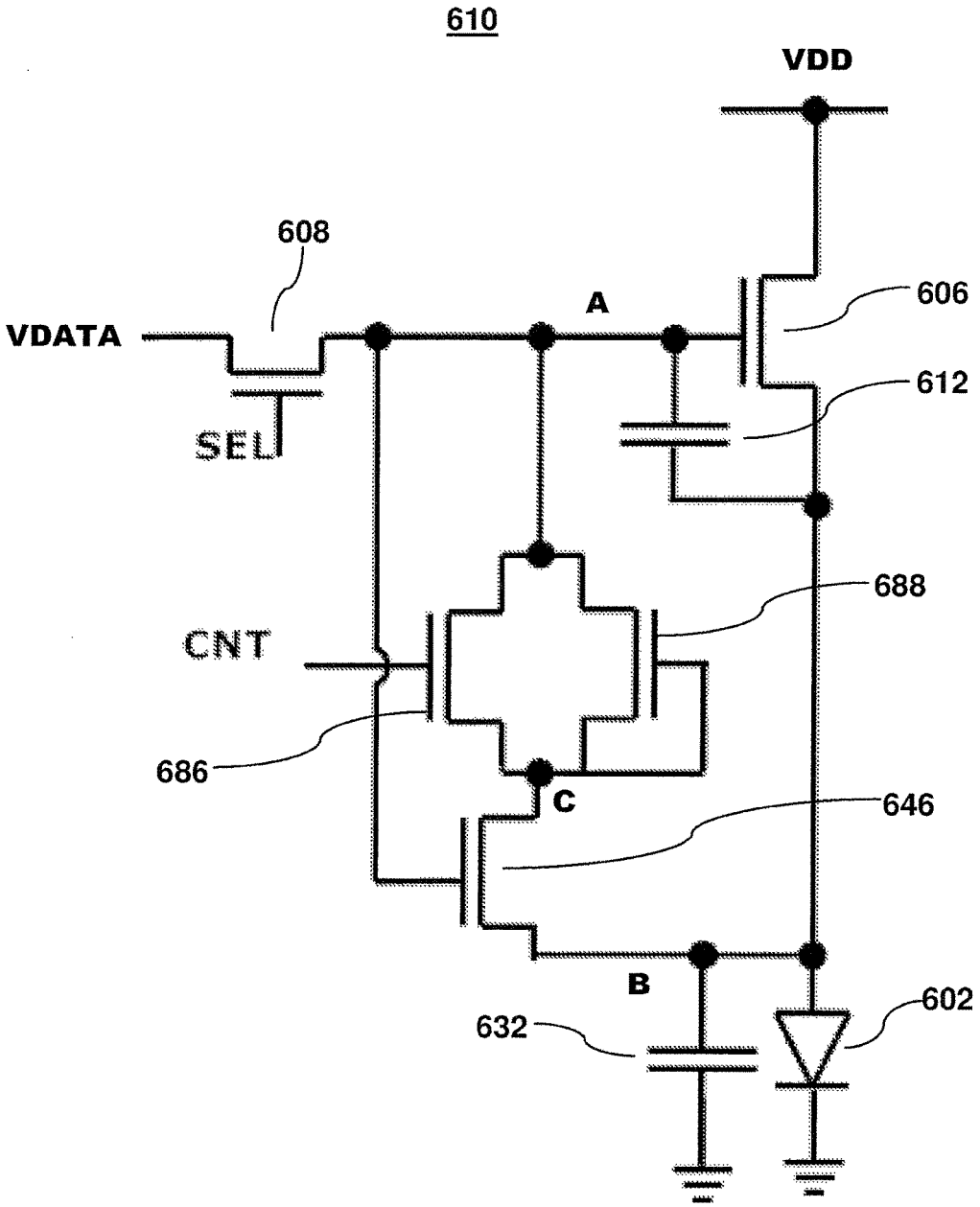
FIG. 40 is a diagram illustrating an example of a pixel circuit to which a pixel drive scheme in accordance with a further embodiment of the present invention is applied.

FIG. 40 illustrates an example of a pixel circuit to which a pixel drive scheme in accordance with another embodiment of the invention is applied. The pixel circuit 610 is programmed according to programming information during a programming cycle, and driven to emit light according to the programming information during an emission cycle. The pixel circuit 610 of FIG. 40 includes an OLED 602 and a drive circuit for driving the OLED 602. OLED 602 is a light emitting device for emitting light during the emission cycle. OLED 602 has capacitance 632. The OLED 602 includes, for example, an anode electrode, a cathode electrode and an emission layer between the anode electrode and the cathode electrode.

The drive circuit includes a drive transistor 606, a first switch transistor 608, a second switch transistor 688, a storage capacitor 612, a discharging transistor 686 and a regulating transistor 646. The drive transistor 606 conveys a drive current through the OLED 602 during the emission cycle. The storage capacitor 612 is charged with a voltage based at least in part on the programming information during the programming cycle. The first switch transistor 608 is operated according to a select line and conveys the voltage to the storage capacitor 612 during the programming cycle. The discharging transistor 686 discharges the voltage on the storage capacitor 612 during the emission cycle. The regulating transistor 646 conveys a leakage current to a gate terminal of the drive transistor 606, thereby adjusting a gate voltage of the drive transistor 606.

In one example, the transistors 606, 608, 646 and 686 are n-type transistors. In another example, the transistors 606, 608, 646 and 686 are p-type transistors or a combination of n-type and p-type transistors. In one example, each of the transistors 606, 608, 646 and 686 includes a gate terminal, a source terminal and a drain terminal.

The transistors 606, 608, 646 and 686 may be fabricated using amorphous silicon, nano/micro crystalline silicon, poly silicon, organic semiconductors technologies (e.g., organic TFT), NMOS/PMOS technology or CMOS technology (e.g., MOSFET).

The drive transistor 606 is provided between a voltage supply line VDD and the OLED 602 directly or through a switch. One terminal of the drive transistor 606 is connected to VDD. The other terminal of the drive transistor 606 is connected to one electrode (e.g., anode electrode) of the OLED 602. The gate terminal of the first switch transistor 608 is connected to a select line SEL. One terminal of the switch transistor 608 is connected to a data line VDATA. The other terminal of the switch transistor 608 is connected to node A. One terminal of the storage capacitor 612 is connected to node A. The other terminal of the storage capacitor 612 is connected to the OLED 602 at node B. The other electrode (e.g., cathode electrode) of the OLED 602 is connected to a power supply line (e.g., common ground).

The gate terminal of the discharging transistor 686 is connected to a control line CNT. The control line CNT may correspond to CNT[n] of FIG. 35. One terminal of the discharging transistor 686 is connected to node A. One terminal of the second switch transistor 688 is connected to node A. The other terminal of the discharging transistor 686 is connected to the other terminal of the second switch transistor 688 at node C. The gate terminal of the second switch transistor 688 is connected to node C.

One terminal of the regulating transistor 646 is connected to node C. The second terminal of the regulating transistor 646 is connected to one electrode (e.g., anode electrode) of the OLED 602. The gate terminal of the regulating transistor is connected to node A. Thus, regulating transistor 646 is biased in sub-threshold regime, providing very small current. However, over the frame time, this small current is enough to change the gate voltage of the drive transistor 606. At higher temperatures, the sub-threshold current of the regulating transistor 646 increases significantly, reducing the average gate voltage of the drive transistor 606.

According to this embodiment, the pixel circuit 610 provides constant averaged current over the frame time.

Figure 41:
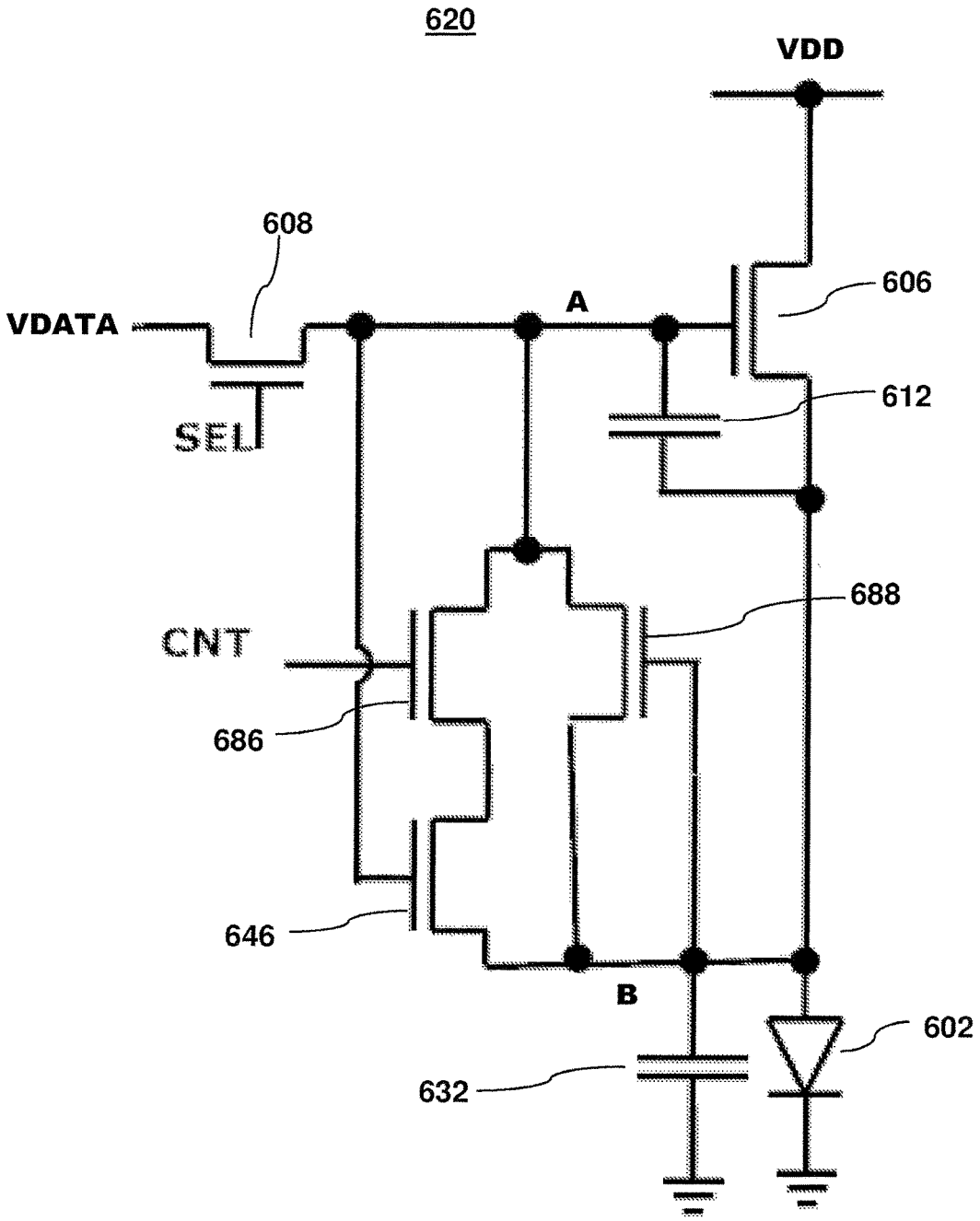
FIG. 41 is a diagram illustrating an example of a pixel circuit to which a pixel drive scheme in accordance with another embodiment of the present invention is applied.

FIG. 41 illustrates an example of a pixel circuit to which a pixel drive scheme in accordance with a further embodiment of the invention is applied. The pixel circuit 620 is programmed according to programming information during a programming cycle, and driven to emit light according to the programming information during an emission cycle. The pixel circuit 620 of FIG. 41 includes an OLED 602 and a drive circuit for driving the OLED 602. OLED 602 is a light emitting device for emitting light during the emission cycle. OLED 602 has capacitance 632. The OLED 602 includes, for example, an anode electrode, a cathode electrode and an emission layer between the anode electrode and the cathode electrode.

The drive circuit includes a drive transistor 606, a first switch transistor 608, a second switch transistor 688, a storage capacitor 612, a discharging transistor 686 and a regulating transistor 646. The drive transistor 606 conveys a drive current through the OLED 602 during the emission cycle. The storage capacitor 612 is charged with a voltage based at least in part on the programming information during the programming cycle. The first switch transistor 608 is operated according to a select line and conveys the voltage to the storage capacitor 612 during the programming cycle. The discharging transistor 686 discharges the voltage on the storage capacitor 612 during the emission cycle. The regulating transistor 646 conveys a leakage current to a gate terminal of the drive transistor 606, thereby adjusting a gate voltage of the drive transistor 606.

The drive transistor 606 is provided between a voltage supply line VDD and the OLED 602 directly or through a switch. One terminal of the drive transistor 606 is connected to VDD. The other terminal of the drive transistor 606 is connected to one electrode (e.g., anode electrode) of the OLED 602. The gate terminal of the first switch transistor 608 is connected to a select line SEL. One terminal of the switch transistor 608 is connected to a data line VDATA. The other terminal of the switch transistor 608 is connected to node A. One terminal of the storage capacitor 612 is connected to node A. The other terminal of the storage capacitor 612 is connected to the OLED 602. The other electrode (e.g., cathode electrode) of the OLED 602 is connected to a power supply line (e.g., common ground).

The gate terminal of the discharging transistor 686 is connected to a control line CNT. The control line CNT may correspond to CNT[n] of FIG. 35 or control line CNT of FIG. 40. One terminal of the second switch transistor 688 is connected to node A. The other terminal of the second switch transistor 688 is connected to the OLED 602 at node B. The gate terminal of the second switch transistor is connected to the OLED 602 at node B.

One terminal of the discharging transistor 686 is connected to node A. The other terminal of the discharging transistor 686 is connected to one terminal of the regulating transistor 646. The other terminal of the regulating transistor 646 is connected to one electrode (e.g., anode electrode) of the OLED 602 at node B. The gate terminal of the regulating transistor is connected to node A. Thus, regulating transistor 646 is biased in sub-threshold regime, providing very small current. However, over the frame time, this small current is enough to change the gate voltage of the drive transistor 606. At higher temperatures, the sub-threshold current of the regulating transistor 646 increases significantly, reducing the average gate voltage of the drive transistor 606.

According to this embodiment, the pixel circuit 610 provides constant averaged current over the frame time.

According to another embodiment, a method of operating a display having a pixel circuit 600, 610 or 620 for driving a light emitting device is provided. The method comprises charging the pixel circuit, during a programming cycle, by turning on a first switch transistor, such that a voltage is charged on a node of the pixel circuit coupled to a capacitor and a gate terminal of a drive transistor; conveying a leakage current by a regulating transistor to the gate terminal of the drive transistor, thereby adjusting the voltage at the node; and discharging the voltage at the node through a discharging transistor, during an emission cycle, during which the pixel circuit is driven to emit light according to programming information.

According to the embodiments of the present invention, the drive circuit and the waveforms applied to the drive circuit provide a stable AMOLED display despite the instability of backplane and OLED. The drive circuit and its waveforms reduce the effects of differential aging of the pixel circuits. The pixel scheme in the embodiments does not require any additional driving cycle or driving circuitry, resulting in a row cost application for portable devices including mobiles and PDAs. Also it is insensitive to the temperature change and mechanical stress, as it would be appreciated by one of ordinary skill in the art.

One or more currently preferred embodiments have been described by way of examples as described above. It will be apparent to persons skilled in the art that a number of variations and modifications can be made without departing from the scope of the invention as defined in the claims.

What is claimed is:

1. A display comprising:

an array of pixel circuits arranged in rows and columns, each of the pixel circuits including:

a light emitting device for emitting light; and a drive circuit for driving the light emitting device;

a temperature sensor associated with at least one pixel circuit and having a sensing terminal coupled to an internal node of a first pixel circuit of the at least one pixel circuit, the drive circuit of the first pixel circuit coupled directly to the internal node, a conductance of the temperature sensor depending upon the temperature of the first pixel circuit, a changing voltage of the internal node discharging through the temperature sensor based on the conductance of the temperature sensor constituting a time-varying sensor output of the temperature sensor, a read-back circuit controllably coupled to said temperature sensor via said internal node and producing a time-varying output signal based on said time-varying sensor output when coupled to said temperature sensor, said internal node being interposed between said temperature sensor and said read-back circuit, at least one controllable switch coupling said read-back circuit to said temperature sensor, and, a data driver circuit coupled to said read-back circuit and to said pixels and providing programming signals to said pixels based in part on variations in said time-varying output signal from said read-back circuit.

2. The display of claim 1, wherein the temperature sensor is shared between two or more of the pixel circuits.

3. The display of claim 1, wherein the sensing terminal of the temperature sensor is controllably coupled to the internal node of the pixel circuit.

4. The display of claim 1, wherein the time-varying output signal of the read-back circuit is used to compensate for the change in the characteristics of the pixel circuit by calibrating a programming voltage stored in a storage capacitor of the pixel circuit.

5. The display of claim 4, which includes a data line controllably coupled to said storage capacitor via said internal node.

6. The display of claim 1, which includes multiple temperature sensors associated with different pixels or groups of pixels, and multiple read-back circuits, each of which is coupled to a different temperature sensor.

7. The display of claim 6, wherein the time-varying output signal of the read-back circuit is used to compensate for the change in the characteristics of the pixel circuit by calibrating a programming voltage stored in a storage capacitor of the pixel circuit.

8. The display of claim 1, in which the programming signals are calibrated based on the time-varying output signal of the read-back circuit.

9. The display of claim 1, in which the data driver circuit generates programming data, calibrates the programming data, and drives data lines to the pixels with the calibrated programming data.

10. The display of claim 1, wherein said programming signals compensate for the change in the temperature of the pixel circuit.

* * * * *